US005823671A

United States Patent [19]

Mitchell et al.

[11] Patent Number: 5,823,671

[45] Date of Patent: Oct. 20, 1998

[54] APPARATUS AND METHOD OF MIXING MATERIALS IN A STERILE ENVIRONMENT

[75] Inventors: Mark E. Mitchell, Fremont; Philip R. Palin, Pleasanton; Daniel R. Prows, Los Gatos, all of Calif.

[73] Assignee: Collagen Corporation, Palo Alto, Calif.

[21] Appl. No.: 555,270

[22] Filed: Nov. 8, 1995

Related U.S. Application Data

[63] Continuation of Ser. No. 241,244, May 10, 1994, abandoned.

[51] Int. Cl.[6] ..... B01F 5/12

[52] U.S. Cl. ..... 366/268; 366/269; 366/342; 366/176.3; 366/348

[58] Field of Search ..... 366/332, 256, 366/257, 258, 259, 260, 176.1, 176.3, 129, 348, 349, 267, 268, 269; 604/82, 87, 88

[56] References Cited

U.S. PATENT DOCUMENTS

| | | | |
|---|---|---|---|
| 1,458,067 | 6/1923 | Linton . | |
| 2,477,598 | 3/1949 | Hain | 366/332 |
| 2,716,272 | 8/1955 | Wenk . | |
| 2,859,017 | 11/1958 | Trumbull et al. | 366/257 |
| 3,010,705 | 11/1961 | Brown | 604/82 |
| 3,390,580 | 7/1968 | Taylor . | |
| 3,700,215 | 10/1972 | Hardman | 366/332 |
| 3,793,718 | 2/1974 | Okazaki . | |
| 3,949,073 | 4/1976 | Daniels et al. | 424/177 |
| 3,952,393 | 4/1976 | Van Ravenzway . | |
| 4,106,779 | 8/1978 | Zabrik . | |
| 4,240,644 | 12/1980 | Busto . | |
| 4,347,002 | 8/1982 | Born | 366/176.3 |
| 4,548,509 | 10/1985 | Parrott et al. . | |
| 4,626,700 | 12/1986 | Tanaka et al. . | |
| 4,651,623 | 3/1987 | Rogers . | |
| 4,754,984 | 7/1988 | Keba . | |
| 4,805,758 | 2/1989 | Dominico et al. . | |
| 4,846,780 | 7/1989 | Galloway et al. . | |
| 4,881,326 | 11/1989 | May . | |
| 4,883,150 | 11/1989 | Arai . | |
| 5,002,463 | 3/1991 | Breckner et al. . | |
| 5,143,382 | 9/1992 | Maringer . | |
| 5,328,441 | 7/1994 | Carr . | |
| 5,356,367 | 10/1994 | Carr . | |
| 5,425,698 | 6/1995 | Carr . | |

FOREIGN PATENT DOCUMENTS

| | | |
|---|---|---|
| 92975 | 11/1983 | European Pat. Off. . |
| 324934 | 7/1989 | European Pat. Off. . |
| 2152452 | 4/1973 | France . |
| 2158118 | 6/1973 | France . |
| 35486 | 6/1886 | Germany . |
| 2216340 | 11/1973 | Germany . |
| 56-76349 | 6/1981 | Japan . |
| 56-76350 | 6/1981 | Japan . |
| 59-115129 | 7/1984 | Japan . |
| 62-228116 | 10/1987 | Japan . |
| 229277 | 8/1925 | United Kingdom . |
| 1052971 | 12/1962 | United Kingdom . |
| 2048090 | 12/1980 | United Kingdom . |
| WO 82/04127 | 11/1982 | WIPO . |
| WO 93/12413 | 6/1997 | WIPO . |

OTHER PUBLICATIONS

Patent Abstracts of JP, vol. 005, No. 143 (M–087), Sep. 9, 1981 (Abstract of JP 56–076350), a copy of which is also enclosed.

Patente Abstracts of JP, vol. 008, No. 234 (M–334), Oct. 26, 1984 (Abstract of JP 59–115129), a copy of which is also enclosed.

Patent Abstracts of JP, vol. 012, No. 095 (P–681), Mar. 29, 1988 (Abstract of JP 62–228116), a copy of which is also enclosed.

*Primary Examiner*—Tony G. Soohoo
*Attorney, Agent, or Firm*—Morrison & Foerster, LLP

[57] ABSTRACT

An apparatus for mixing a particulate material into a liquid includes a pair of variable volume receptacles interlinked by a communication passage. A combined volume of liquid and particulate material is received within the variable volumes, and the volume of the variable volumes is alternately reduced and to force the materials back and forth through the connection passage. The variable volumes may be formed from a rigid walled cylinder having a free floating piston therein, and the piston and inner diameter may have a tight, sealed gap therebetween. To load the piston into the cylinder without effecting the seals, a load apparatus may be used to depress the seals inwardly of the piston and align the piston in the cylinder.

26 Claims, 11 Drawing Sheets

APPARATUS AND METHOD OF MIXING MATERIALS IN A STERILE ENVIRONMENT

This application is a continuation of U.S. application Ser. No. 08/241,244, now abandoned, filed May 10, 1994, the disclosure of which is incorporated herein.

BACKGROUND OF THE INVENTION

1. Field of the Invention

The present invention relates generally to methods and apparatuses for dispersing particulate materials in viscous fluids to form a suspension having a uniform concentration of particulates therein. More particularly, the present invention relates to methods and apparatus for mixing a discrete volume of a viscous fluid having a variable concentration of solid or semi-solid particulates suspended therein through multiple receptacle volumes and thereby evenly distribute the particulates within the fluid volume. More particularly still, the present invention relates to the redistribution of collagen fibrils and fibril aggregates in a centrate to form a liquid suspension having a homogeneous concentration of collagen fibrils and fibril aggregates therein, and combining that suspension with one or more carrier fluids to form a homogenous distribution of collagen fibrils and fibril aggregates in suspension in a carrier fluid for ultimate use in humans and/or other mammals.

2. Background of the Art

The precipitation of collagen fibrils from a solution of collagen in a liquid medium, and the preparation of an injectable or implantable collagen suspension by dispersing the fibril collagen into a carrier liquid, are well known in the art. For example, U.S. Pat. No. 3,949,073, Daniels, et al., the disclosure of which is fully incorporated herein by reference, discloses a process for preparing collagen in fibril form for use in human applications. The collagen is primarily derived from mammalian source materials, such as bovine or porcine corium, although human placenta material or recombinanatly produced collagen expressed from a cell line (for example) may be used. To form the fibril collagen from the bovine or porcine sources, a batch of the bovine or porcine corium is first softened by soaking it in a mild acid. After softening, the corium is scraped to remove the hair, fat and epidermis. The depilated corium is again soaked in a mild acid, and then comminuted by grinding, mincing, milling or similar physical treatments. This comminution prepares the corium for solubilization in a liquid medium.

The comminuted corium is solubilized under non-denaturing conditions by dispersing it in an aqueous medium and digesting it with a proteolytic enzyme other than collagenase, preferably an enzyme such as pepsin or papain that is active at acidic pHs. Pepsin is the preferred digesting enzyme, because it is easily removed from the solution after the digestion end point is reached. The preferred enzyme concentration is 0.1 to 10.0 weight percent, based upon the weight of the collagen. To avoid denaturing, the liquid medium will typically include a dilute acid such as HCl or a carboxylic acid therein, and the solubilizing mixture will be maintained at relatively low temperatures. During solubilization, the pH of the mixture will normally be in the range of about 1.5 to 5.0, depending on the enzyme used, and the temperature is maintained at about 5° C. to 25° C. At these conditions, most of the mass of comminuted corium will solubilize in two days to two weeks.

As the corium is digested in the liquid medium, the viscosity of the liquid medium changes. Therefore, the viscosity of the liquid medium may be used as an indicator of the completeness of the digestion of the corium. When the rate of change of the viscosity reaches a preselected low level, the digestion may be considered at end point. When the digestion end point is reached, the concentration of solubilized collagen in the liquid medium is preferably on the order of 0.3 to 5.0 milligrams of collagen per milliliter of liquid medium. Once the digestion end point is reached the non-digested corium and denatured enzyme formed by digesting the comminuted corium in the liquid medium is removed by filtering, dialysis, or sedimentation.

Once the non-digested corium and denatured enzyme are removed from the liquid medium, fibrils of atelopeptide collagen may be precipitated from the liquid medium. Preferably, the fibrils of collagen are precipitated from the liquid medium by raising the pH of the liquid medium which causes collagen molecules to begin precipitating out of the liquid medium. By adding an appropriate base or buffer such as $Na_2HPO_4$ or NaOH at a desired rate, the pH level of the liquid medium may be controllably raised to institute the generation of collagen fibrils from the precipitating collagen molecules. Over the course of the precipitation step, the collagen molecules will join to form fibrils having a range of sizes, and the fibrils may interconnect to form collagen fibril aggregates. The fibril aggregates may be formed by mechanical and/or weak hydrogen bonding between the individual collagen fibrils, or may simply be closely associated groups of fibrils or smaller fibril aggregates. The fibrils and fibril aggregates may be cross-linked, if desired, by using various methods known in the art such as heat treatment or irradiation. Chemical cross-linking agents may also be used to create covalently cross-linked collagen. Once the fibrils and fibril aggregates are sufficiently formed, and if desired, cross-linked, the collagen fibrils and fibril aggregates are separated from the liquid medium, preferably by centrifuging. At this point, the usable collagen from the batch of corium is in the form of a high concentration centrate of collagen fibrils and fibril aggregates in liquid medium. The centrate preferably has a concentration of 36 to 120 milligrams of collagen fibrils per milliliter of residual liquid medium.

When the suspension of collagen fibrils an fibril aggregates in the liquid medium is centrifuged to form the centrate, the force required to cause the collagen fibrils and fibril aggregates to collect in the centrifuge container also causes most of these collagen fibrils and fibril aggregates to become packed together and form larger fibril aggregates from mechanical interaction, weak hydrogen bonding, or close association in the residual liquid remaining in the centrate. Thus, after centrifuging, the fibril aggregates in the centrate may be formed from as few as two to an innumerable number of fibrils. Further, the fibrils themselves may be formed from as few as one to an innumerable number of collagen molecules. The size of the largest fibril aggregate is variable, depends upon multiple independent processing factors. Additionally, the concentration of collagen fibrils in the centrate will vary within the centrate. Typically, where the collagen fibrils are centrifuged, the fibril concentration at the bottom of the centrate is substantially greater than the concentration of fibrils at the top of the centrate.

To ensure that the concentration of collagen in the collagen product prepared from each batch of corium is consistent, the fibril collagen in the centrate must be evenly dispersed within the centrate, and the large fibril aggregates must be dispersed or redistributed. To form an injectable, implantable, or otherwise useable collagen product, the redistributed centrate must be diluted with a liquid carrier, and the diluted centrate must be configured to smoothly flow through an aperture in a needle without clogging or binding. Although the aperture size of the needle will vary with each product and application, most collagen products must pass through a 30 to 31 gauge needle, whereas some cross-linked products may pass through needle apertures as large as 22 gauge. To ensure consistent performance of the collagen product, the concentration of collagen in the liquid carrier may not vary by more than ±10% within a batch of collagen, and the maximum size of any fibril or fibril aggregate in the entire batch of collagen may not exceed the size of a specified needle aperture.

Two methods may be used to ensure that the large fibril aggregates are not found in the final collagen product: The diluted centrate may be screened to physically remove the larger fibril aggregates from the centrate; or, the centrate may be physically agitated to disperse the large fibril aggregates formed during centrifuging into smaller fibril aggregates and individual fibrils. Screening as the sole means of removing the large fibril aggregates, without first agitating the collagen to disperse the larger fibril aggregates, is unacceptable. If screening is used as the only means of limiting the upper size limit of the fibril aggregates, large quantities of valuable product will be screened out of the process stream and discarded. The preferred method of eliminating the large fibril aggregates is to physically disperse, separate, or de-aggregate the large fibril aggregates into smaller acceptably sized aggregates using a physical agitation means. Then, once the aggregate size has been reduced, the collagen may be screened to reduce any remaining oversized collagen fibril aggregates. This latter method maximizes the collagen ultimately recovered from each batch of corium, and also ensures that a maximum fibril aggregate size is present in the final collagen product. Further the physical agitation process may be used to redistribute the collagen fibrils within a liquid medium while simultaneously reducing the maximum fibril aggregate size.

The size of the fibrils and fibril aggregates formed by processing the corium into collagen may be determined using back scattering sampling techniques. One such technique examines the size of the collagen fibrils or aggregates in a diluted sample of the collagen suspension or centrate. The diluted sample is prepared by first taking a small volume of collagen in suspension, or in centrate form, and adding a buffer while gently stirring to distribute the collagen fibrils and fibril aggregates in the total volume of liquid and buffer. After the buffer is added, the preferred concentration of collagen in the total liquid volume is 3.0 mg/ml or less. Once the volume of collagen is diluted, a sample of the diluted volume is smeared on a slide and the slide is positioned between a sampling screen and a light source. The light passing through the sample does not pass through the collagen fibrils and fibril aggregates. Therefore, the fibrils and fibril aggregate cast shadows, or silhouettes, that are projected as dark spaces on the sampling screen. The size and distribution in size of these silhouettes is tabulated and the resulting number, expressed in terms of $\mu m^2$, has a direct relationship to the volumetric size of the individual fibrils and fibril aggregates in the diluted sample. Preferably, this technique is performed using an Olympus Cue-2 analyzer. Using this technique, it has been found that the sizes of the fibrils and fibril aggregates of the collagen in the suspension before centrifuging, in terms of silhouette area, varies from about 500 $\mu m^2$ to about 4000 $\mu m^2$. Additionally, it has been found that the size of the fibrils and fibril aggregates of the non-cross-linked collagen in the centrate, in terms of silhouette area, varies from about 1,000 $\mu m^2$ to about 10,000 $\mu m^2$, and the size of the fibrils and fibril aggregates of the cross-linked collagen in the centrate varies from about 10,000 $\mu m^2$ to about 100,000 $\mu m^2$.

One known method of physically agitating the collagen centrate to reduce the maximum fibril aggregate size below a desired threshold size, while simultaneously dispersing the fibrils and fibril aggregates to create a homogeneous distribution of collagen in the residual liquid medium, employs an upright right circular truncated cone shaped mixing tub having a large upper opening and a small lower opening. A ribbon or wand type of rotating impeller moves within the tub to distribute the centrate within the conical volume of the tub. Where the apparatus is used to mix cross-linked collagen, secondary scrapers must be deployed to scrape the collagen from the sides of the tub. The rotating impeller and scrapers both distribute centrate from the sides of the tub and into the central area of the tub. To pump centrate through the tub, a pump is connected to the narrow end of the cone shaped tub, and a tubing loop is connected to the pump discharge to return the centrate from the pump to the large diameter end of the tub.

When used to mix a viscous fluid, such as the collagen centrate, the conical tub mixer has several limitations which affect its ability reliably de-aggregate the larger fibril aggregates and evenly distribute the collagen in the residual liquid medium. First, the viscous centrate tends to cling to any surface with which it comes into contact, and it therefore forms a film on the tub walls, the scrapers and the ribbon mixer. The tendency of the centrate to form a film on the surfaces of the mixer, in combination with the configuration of the mixer, causes a core of moving centrate to form through the conical tub from the tub inlet to the tub outlet. This core is a moving volume of centrate which recirculates through the pump but does not significantly interact with the remainder of the centrate in the conical tub. The cross-sectional area of the core is approximately equal to the cross-sectional area of the tub outlet to the pump. Therefore, a specific volume of fluid moves through the pump and the tub and a stagnant volume of centrate is created between the moving volume of centrate and the walls of the tub. The scrapers and the mixing impeller help distribute this centrate into the moving volume, but their effectiveness is limited by the tendency of the collagen to stick to their surfaces. Once mixing is completed, the fibrils and fibril aggregates in the volume of centrate in the moving core that passed through the pump will be relatively evenly distributed, but the collagen fibrils and fibril aggregates in the centrate that adhered to the surfaces of the tub, scrapers and ribbon mixer are not evenly distributed. Therefore, to ensure that the concentration of the mixed centrate is relatively continuous and no localized volumes of unmixed collagen are present in the final product, the unmixed portions of the centrate that adhere to the surfaces of the mixer must be disposed of.

Where the conical tub mixer is sized to mix relatively small volumes of centrate, i.e., approximately one to eight liters, the relative quantity of centrate that does not pass through the pump is small. Therefore, the cost of the centrate that must be disposed of because it did not pass through the pump is small. The only way to increase the batch capacity of this conical tub style mixer is to increase the size of the tub and the length of the tubing loop. However, if the size of the tub is significantly increased, the volume of centrate that is not mixed, commonly known as the "hold up" or "hold up volume" becomes unacceptable. Further, if the conical type mixer is scaled to mix quantities of centrate on the order of 10 to 20 liters, the frictional forces created by the adhesion of the centrate to the walls of the mixer and the tubing loop will exceed the head capacity of the pump. As a result, the pump cannot physically pull the centrate from the tub by suction, and cannot physically pump the centrate back into the larger tub through the extended tubing loop. Therefore, the present collagen mixing apparatus is batch size limited.

SUMMARY OF THE INVENTION

The present invention pertains to mixing apparatus and methods of using the apparatus for distributing particulate material in a viscous fluid to create a relatively homogeneous concentration of particulate in the fluid and, if desired, for reducing the maximum particle size of the particulate as the particulate material is distributed in the fluid. In the preferred embodiment, the invention includes a pair of variable volume fluid receptacles which are interlinked by at least one fluid passage. A combined volume of fluid and particulate may be pumped through the fluid passage between the variable fluid volumes to create a homogeneous concentration of the particulate within the fluid. Preferably, each of the variable volume fluid receptacles has an intermediate volume that is greater than the combined volume of the fluid and particulate, and a minimum volume of approximately zero to provide low hold up. By alternately changing the volume of the variable volume fluid receptacles between their intermediate and minimum volumes, the fluid and particulates may be pumped through the fluid passage to affect distribution of the particulate into the fluid. The configuration of the multiple variable volume receptacles, in conjunction with the interconnecting fluid passage, ensures that virtually all of the combined volume of the fluid and particulate will be mixed together to distribute the particulate in the fluid.

In a more preferred embodiment of the invention, the variable volume receptacles are configured as tubular vessels with rigid outer walls, and each vessel includes a free floating piston therein which may be selectively alternately moved in its respective vessel to push the volume of particulate and liquid between the two vessels. In a further sub-embodiment of the more preferred embodiment of the invention, each piston includes a pair of seal members extending about its outer diameter to seal the piston against the interior wall of the vessel. The seals may also form a bearing surface to maintain a minimum separation between the vessel wall and the piston. In a still further sub-embodiment of the invention, the seals are configured to selectively use the pressures within the vessels to increase the sealing force between the seal and the vessel wall when the pressure within the vessel in increased. Additionally, the piston may be magnetically coupled to an external indicator to provide a visual indication of the position of the piston in the tubular vessel.

In a further embodiment of the invention, a piston loading device is provided to load the piston, with the seals therein, into the vessel. The loading device includes a seal biasing means to bias the seals inwardly of the outer surface of the piston to allow the piston to slide into the vessel without binding, pinching, rolling or cutting the seals and without cocking or binding the piston.

The mixing apparatus of the present invention is particularly useful for distributing collagen fibrils and fibril aggregates, and also for further mixing the distributed collagen fibrils and fibril bundles into a carrier fluid to form a dilute collagen-fibril-containing product having a desired uniformity of concentration of collagen in the carrier fluid. Frequently, the source of collagen fibrils is a centrate from prior processing, wherein the collagen fibrils are aggregated within a fluid medium at a high concentration. The centrate may be separately processed in the mixing apparatus to redistribute the collagen fibrils therein, or, the centrate may be diluted with a carrier fluid and then mixed to redistribute the collagen to produce a uniform concentration of collagen in the carrier fluid.

Although several sub-embodiments of the invention are described herein in conjunction with the specific embodiment, each of the sub-embodiments may be used individually, or concurrently, without deviating from the scope of the invention.

These, and other features and advantages of the invention will be apparent from the description of the embodiments, when read in conjunction with the following drawings, wherein:

DESCRIPTION OF THE EMBODIMENTS

I. INTRODUCTION

The present invention provides methods and apparatus for mixing a combined volume of constituents, such as a fluid and a particulate matter, with assurance that the entire combined volume or very nearly the entire combined volume of the constituents will be mixed together. The combined volume may be a fixed volume, or the combined volume may change volume as the individual constituents are intermixed, such as by volume changes which occur during solubilization of one of the constituents into another of the constituents. The apparatus is particularly useful as a batch mixer for mixing highly viscous, high value products which must be maintained in a sterile environment, such as pharmaceuticals or other materials that may be used in humans and/or mammals. One such use is the redistributing of fibrils and fibril aggregates of collagen in a centrate 18 and for mixing the centrate 18 into a liquid carrier, and the invention will be primarily described with respect to this process. Additionally, the apparatus may be used to de-aggregate the larger fibril aggregates in the centrate. However, the invention is useful for distributing any particulate into a liquid, and should not be considered limited to the processing of collagen.

Figure 1:
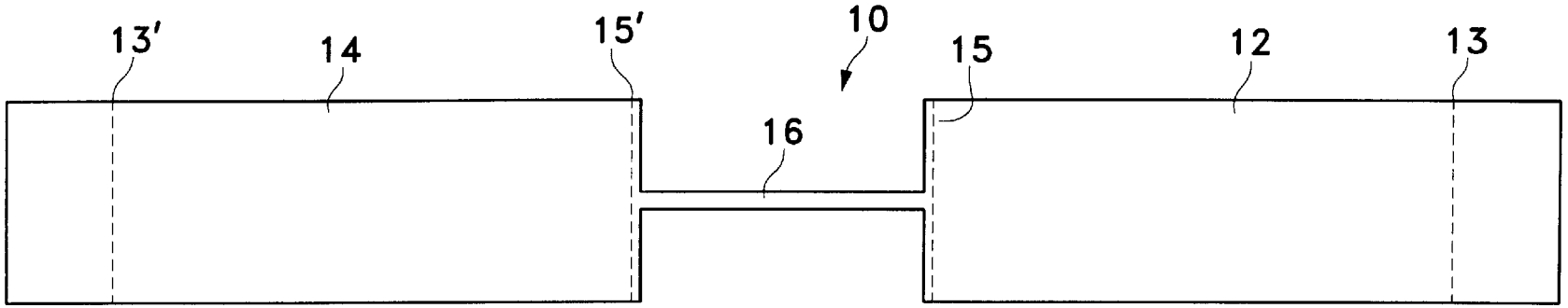
FIG. 1 is a simplified schematic view of a collagen mixing process of the present invention.

As shown in a schematic representation in FIG. 1, the invention generally includes a first variable volume member 14 a second variable volume member 14 which are interconnected by a fluid passage 16. To redistribute and de-aggregate materials, for example a collagen centrate 18 having a relatively high concentration of collagen fibrils and fibril aggregates in a residual carrier liquid, a combined volume of the material is loaded into the first variable volume member 12 to the level shown at line 13. The volume of the first variable volume member 12 is then reduced to the volume shown at line 15, which forces nearly all of the material from the first variable volume 12 through the fluid passage 16 and into the second variable volume 14. Preferably, the volume of the second variable volume 14 is reduced to its minimum volume, as referenced at line 15', before the material is forced through the fluid passage 16. Thus, as the first fluid volume 12 is reduced, the second fluid volume 14 is increased as the material moves therein through the fluid passage 16. By alternately reducing the first and second variable volumes 12, 14, the material is passed through the fluid passage 16 multiple times which distributes the particulates into the liquid medium to a desired uniform concentration of particulate within the liquid, and may simultaneously reduce the mean particle size. Where the material being mixed is a collagen centrate 18, the fibrils and fibril aggregates are redistributed to a desired uniformity, and the larger aggregates are de-aggregated into smaller aggregates and individual fibrils as the centrate 18 is moved between the variable volumes 12, 14. The apparatus 10 may also be used to mix the redistributed centrate 18 into a fluid carrier to form a final collagen product.

II. THE PREFERRED EMBODIMENT OF THE MIXING APPARATUS

Figure 2:
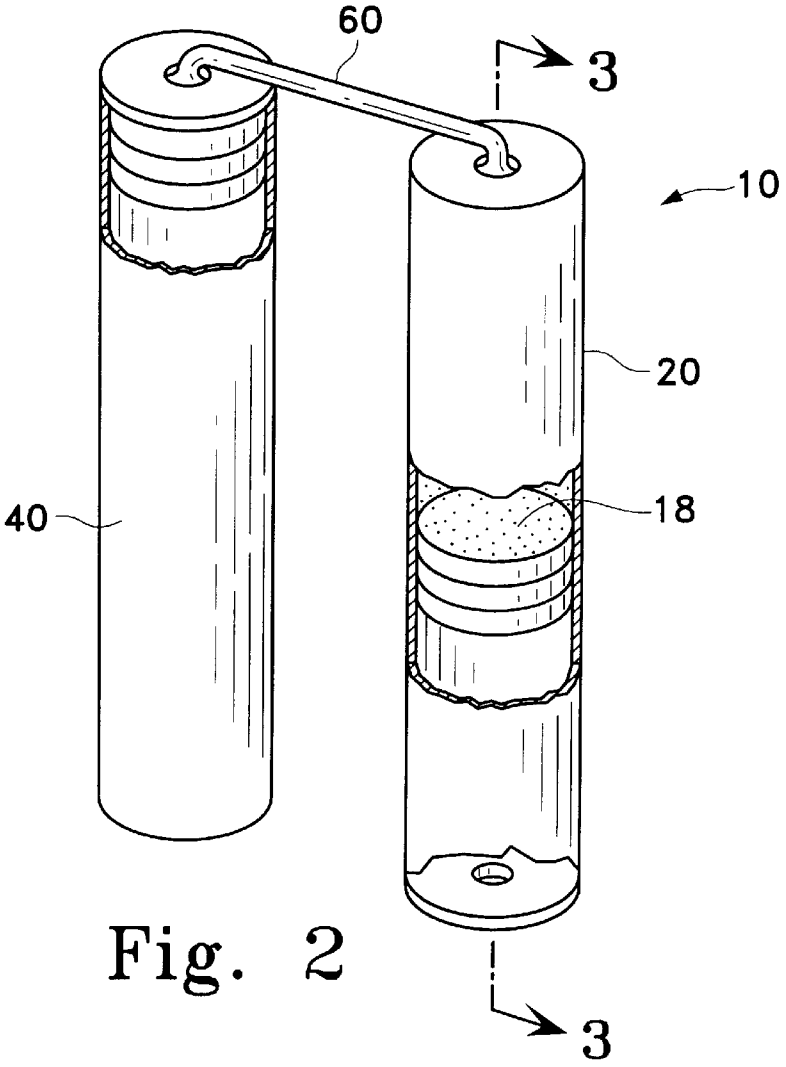
FIG. 2 is a perspective view, partially in section, of the preferred embodiment of the mixing portion of the apparatus of the present invention.

Referring now to FIG. 2, a preferred embodiment of the mixing apparatus 10 of the present invention is shown for redistributing and if desired de-aggregating, collagen fibrils and fibril aggregates within a centrate 18 and then mixing the centrate 18 into a carrier fluid. In this preferred embodiment of the apparatus 10, the first variable volume member 12 is configured as a first cylinder 20, the second variable volume member 14 is configured as a second cylinder 40, and the fluid passage 16 is configured as a fluid interchange 60 interconnecting the cylinders 20, 40. The fluid interchange 60 may include one or more fluid passages interconnecting the cylinders 20, 40, and only one such passage is shown in FIG. 2. The cylinders 20, 40 are preferably identically configured to receive a discrete volume of collagen centrate 18 and pass the centrate 18 through the fluid interchange 60 to redistribute the collagen fibrils and fibril aggregates in the centrate 18 to a desired degree of uniformity, and to de-aggregate the fibril aggregates into smaller fibril aggregates and individual fibrils.

The apparatus 10 functions by forcing a combined volume of centrate 18 back and forth through the fluid interchange 60. Preferably, the cross-sectional area of the cylinders is at least 20 times the cross sectional area of the fluid interchange 60. Further, the centrate 18 preferably flows through the fluid interchange 60 between the two cylinders 20, 40 at a rate of approximately one liter per second, and the fluid interchange 60 is sized to ensure turbulent movement of the centrate 18 through the fluid interchange 60. Once the collagen has been processed in the apparatus 10, the entire volume of collagen, less a relatively small hold up volume retained in the fluid interchange 60, is passed on to the next processing step wherein it may be packaged for use or further processed.

A. THE CONFIGURATION OF THE CYLINDERS

Figure 3:
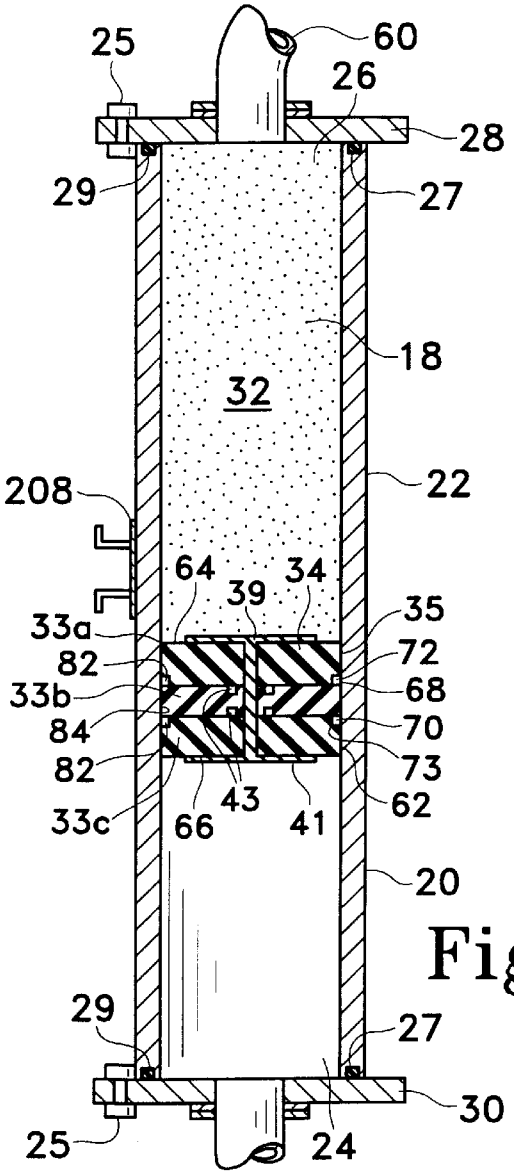
FIG. 3 is a sectional view of one of the mixing cylinders of FIG. 2 at section 3—3.

Referring now to FIG. 3, the configuration of the preferred embodiment of the cylinders 20, 40 is shown. For ease of understanding, the details of construction of the preferred embodiment of the apparatus 10 are described with respect to cylinder 20, it being understood that the details of constructions of the cylinder 40 are identical to those of cylinder 20. Where the elements of both of the cylinders 20, 40 are described, the elements of cylinder 40 carry the same numeric descriptor but include a "'" designation, for example, piston 34'. The cylinder 20 includes a tubular shell 22 with opposed open lower and upper ends 24, 26, a lower cover plate 30 disposed over the lower open end 24 and an upper cover plate 28 disposed over the upper open end 26. The cover plates 28, 30 are releasably attached to the ends 24 and 26, preferably with swinging bolt and wing nut combinations 25. An o-ring 27 or other seal member is retained in a seal groove 29 in each end of the sleeve 22. The o-ring 27 is preferably formed from silicone, and it forms a seal between the sleeve 22 and each of the cover plates 28, 30. A piston 34 is located within the shell 22, and is actuatable therein between the cover plates 28, 30 as will be further described herein.

B. THE CONFIGURATION OF THE APPARATUS FOR STERILIZATION

To prevent contamination of the centrate 18, the centrate 18 and any carrier fluid must be mixed in a sterile environment. Additionally, all of the materials which the centrate 18 may contact must be non-cytotoxic, non-extractable materials. Preferably, the shell 22 and cover plates 28, 30 are fabricated from stainless steel, and the piston 34 is fabricated from polysulfone and stainless steel. Alternatively, the shell 22 may be fabricated from polysulfone. These individual components of the cylinders 20, 40, the components and fittings of the fluid interchange 60 and any other article which the centrate 18 or carrier fluid may contact must also be sterilized. To provide a sterilized environment, the entire apparatus 10 of the present invention is configured to be disassembled for cleaning such as by autoclaving and then assembled and used in a class 100 clean room environment.

Figure 4:
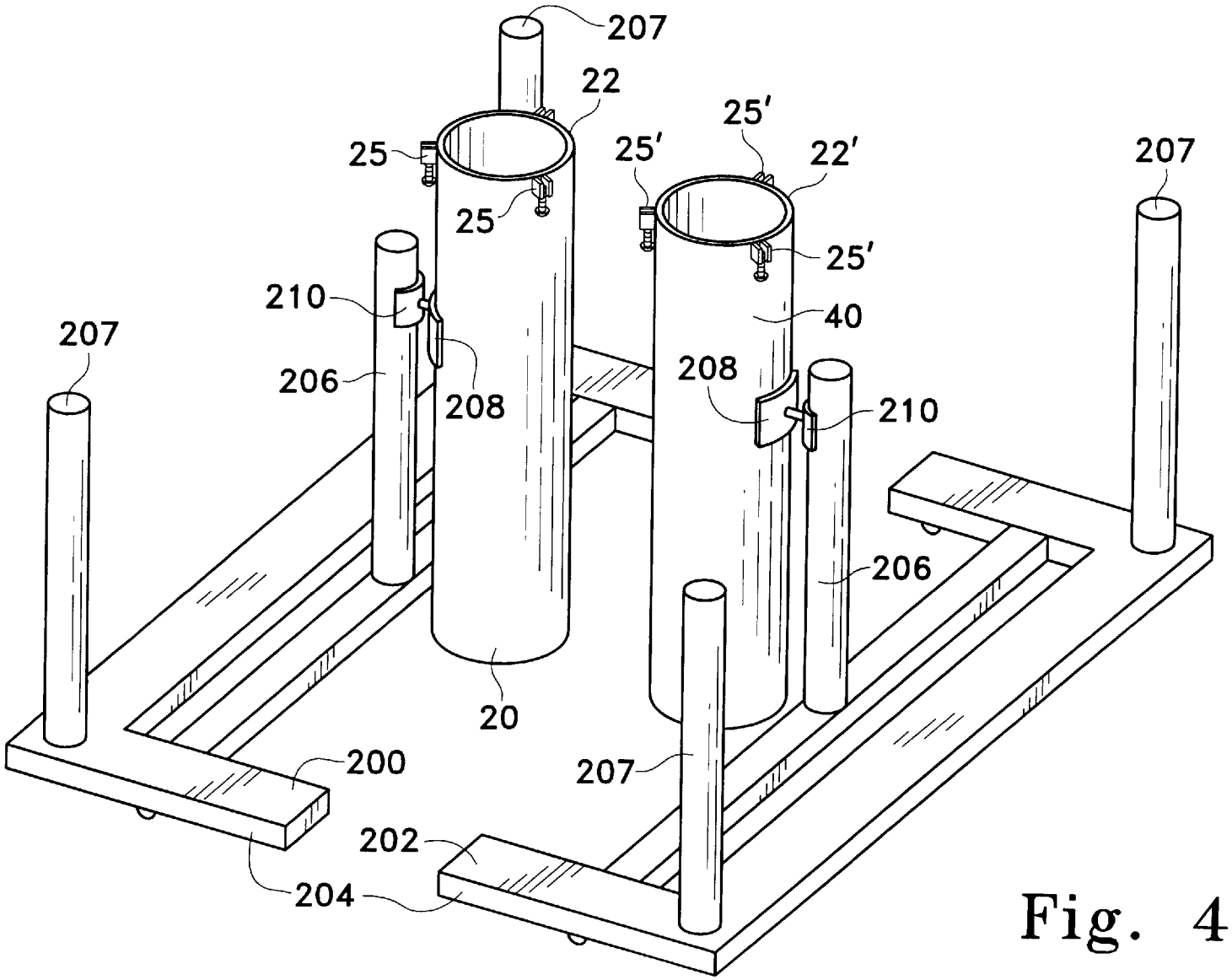
FIG. 4 is a perspective view of the shells of the mixing apparatus of the present received on moveable carts.

To facilitate sterile handling of the components of the apparatus, the sleeve 22 of the cylinder 20 is configured to connect to a cart 200, and the sleeve 22' of the cylinder 40 is configured to connect to a cart 202 as shown in FIG. 4. The carts 200, 202, with the sleeves 22, 22' attached thereto, are sized to fit in an autoclaving chamber, and the carts 200, 202 allow the sleeves 22, 22' to be moved from the autoclaving chamber after sterilization without the sleeve 22, 22' being touched or otherwise contaminated. The carts and sleeve 22, 22', the pistons 34 (shown in FIG. 3), cover plates 28, 30 (shown in FIG. 3) and all seals, fittings and valves which may contact the centrate 18 of the carrier fluid are sterilized, preferably by autoclaving.

Each of the carts 200, 202 include a base 204 generally configured as a U-shaped member with wheels, a support 206 extending upwardly from the base 204 and a pair of steering rods 207. Each of the sleeves 22, 22' includes a mounting plate 208 on the outer surface thereof (best shown in FIG. 3) which is interconnected to the support 206 by a swivel rod 210. Each sleeve 22, 22' may be rotated 360° about the swivel rod 210, which allows the cylinder 20, 40 to be easily manipulated for placement of the sterilized componentry into or onto the cylinders 20, 40. By moving the carts 200, 202 with the steering rods 207, the sleeves 22, 22' may be moved after autoclaving without being touched or otherwise contaminated.

C. THE PREFERRED OPERATION AND INTERACTION OF THE MIXING CYLINDERS

The mixing cylinders 20, 40 are preferably configured to alternately force the centrate 18 therefrom and receive the centrate 18 therein. To perform this function, the volume within the cylinder 20 which receives the centrate 18 may be varied by moving the piston 34 within the cylinder 20. Referring again to FIG. 3, the volume of the cylinder 20 which may receive the centrate 18 is defined as the volume between the piston 34, the upper cover plate 28 and the inner wall of the shell 22. Therefore, as the piston 34 moves within the shell 22, the distance between the piston 34 and the cover plate 28, and thus the volume in the cylinder 20 which may receive the centrate 18, is reduced. When the piston 34 is moved fully upwardly to the shell 22, the minimum volume of centrate 18 is located in cylinder 20. When the piston 34 is fully withdrawn from the cover 28, the maximum volume of centrate 18 is received in the cylinder 20. Thus, the cylinder 20 has a variable volume 32 for receiving the centrate 18. Preferably, the maximum volume of the cylinder 20 is at least as great as the maximum volume of centrate 18, and the minimum volume of the cylinder is approximately zero to provide minimum hold up of the collagen product. By configuring the cylinders 20, 40 so that their minimum volume is approximately zero, virtually all of the centrate 18 will be alternately forced between the two cylinders 20, 40 during mixing.

D. THE PREFERRED PISTON CONFIGURATION

The movement of the piston 34 upwardly within the shell 22 of the cylinder 20 is used to apply all of the force on the centrate 18 needed to force the centrate 18 from the cylinder 20, through the fluid interchange 60, and into the cylinder 40. As shown in FIG. 3, the piston 34 is preferably a fully pneumatic/hydraulic piston 34, i.e., no mechanical linkage is provided to drive the piston 34 within the shell 22, the interface of the piston 34 and the shell 22 must have minimal friction. Additionally, the annular area, or gap 35, between the piston 34 and the shell 22 must be sealed, and the piston 34 must be configured to resist twisting, binding or cocking as it moves through the shell 22. To meet these requirements, the piston 34 must be sized to closely match the inner diameter of the shell 22 to limit the size of any leak path between the piston 34 and the wall of the shell 22, but must be isolated from contact with the shell 22 to minimize friction and to avoid twisting, binding or cocking.

Figure 5:
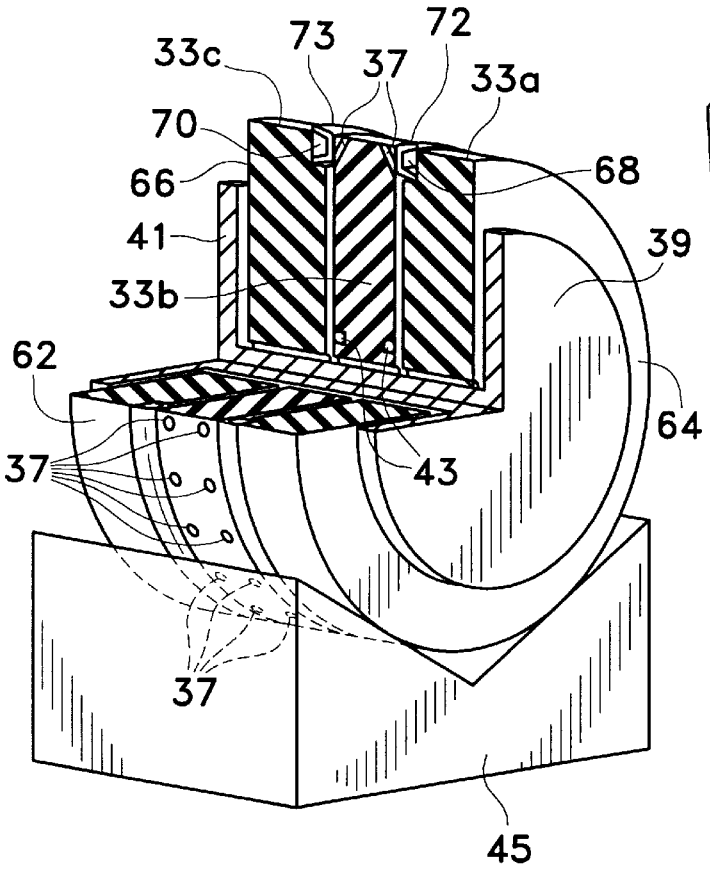
FIG. 5 is a perspective view, partially in section, of the piston configured for autoclaving.
Figure 6:
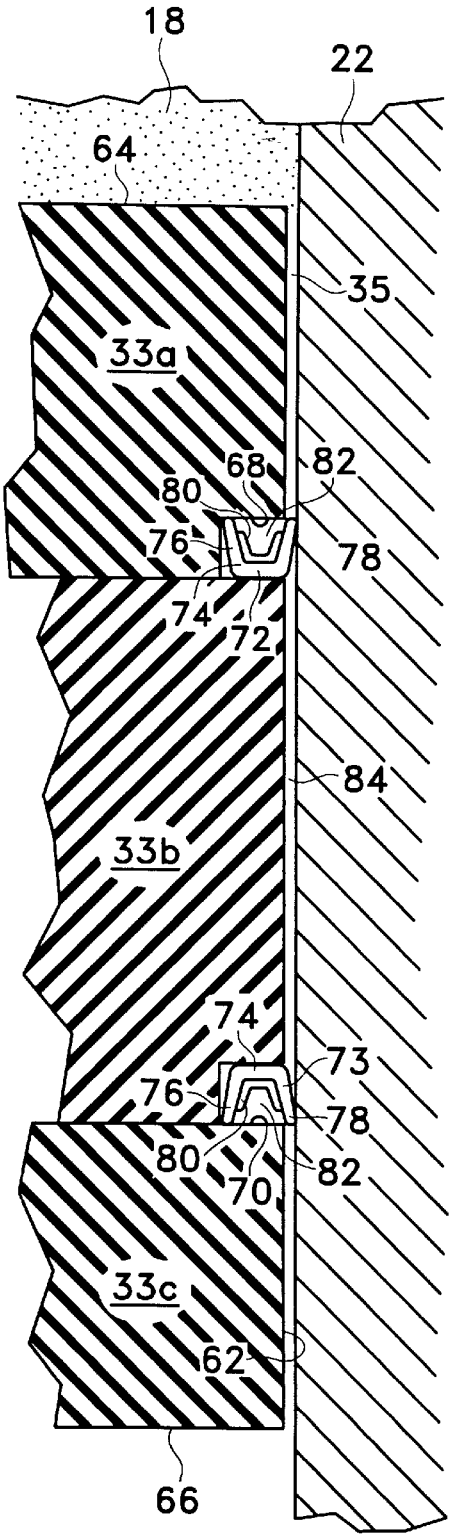
FIG. 6 is a partial sectional view of the piston and a portion of a mixing cylinder of the present invention.

Referring now to FIGS. 3, 5 and 6, the piston 34 is preferably a multi-element member formed from a plurality of disks 33*a–c*, preferably manufactured from polysulfone, interconnected by an upper plate and stud assembly 39 and a lower plate 41. The stud of the upper plate and stud assembly 39 extends through aligned apertures in the disks 33, and is received in the lower disk 41 to securely connect the disks 33*a–c* together to form the piston 34. A seal 43, preferably configured from silicone, is provided between each disk adjacent the apertures to isolate the stud. The piston 34 thus formed includes an outer cylindrical surface 62 bounded by an upper circular face 64 and a lower circular fact 66. The mean gap 35 (best shown in FIG. 6) between the piston 34 and the inner wall of the shell 22 is preferably on the order of 0.004 inches. An upper seal groove 68 and a lower seal groove 70 are disposed in the outer cylindrical surface 62 of the piston 34 and extend circumferentially thereabout. The seal groove 68 is disposed at the interface of the uppermost disk 33 and the middle disk 33*b* and includes a seal ring 72 therein, and the seal groove 70 is disposed at the interface of the center disk 33*b* and the lowermost disk 33*c* and it includes a seal ring 73 therein. The seal rings 72, 73 are configured to span the gap 35 between the piston 34 outer circumferential surface 62 and the inner wall of the shell 22, and to form a circumferential bearing surface on which the piston 34 slides along the inner wall of the shell 22 to maintain the piston 34 in a non-contacting relationship with the inner wall of the shell 22. By sliding the piston 34 on the seals 72, 73, the friction between the piston 34 and the shell 22 is minimized which reduces the residual pressure needed to begin movement of the piston 34 in the shell 22 and permits greater control of piston 34 movement within the shell 22. The seal rings 72, 73 also provide a means of centering the piston 34 within the shell 22, and thus help prevent twisting, binding or cocking of the piston 34 within the shell 22.

As discussed supra, all surfaces that contact the centrate must be sterile. The piston 34 is specifically configured to be easily sterilized. Referring to FIG. 5, the piston 34 is shown partially assembled for autoclaving. In this configuration, the stud portion of the upper plate and stud assembly 39 is only partially received in the lower plate 41 of the piston 34, which allows the disks 33*a–c* of the piston 34 to be separated slightly during autoclaving. Further, a plurality of apertures 37 are provided through the outermost disks 33*a*, 33*c* around the circumference of the piston 34, and they terminate behind the seal grooves 68, 70 . The gaps between the disks 33*a–c*, and the porting affect of the apertures 37 ensure that steam can contact all surfaces of the piston 35, including the back of the grooves 68, 70 and the back surfaces of the seals 72, 73 to ensure sterility. Further, the apertures 37 allow any condensation that forms adjacent the grooves 68, 70 during autoclaving to drain from the piston 34. Finally, during the autoclaving process, the piston 34 is held on its side on a fixture 45. This further ensures that any condensation that may form on the piston 34 during autoclaving drains from the piston 34 before use.

Referring now to FIG. 6, the preferred orientation and structure of the seal rings 72, 73 and the grooves 68, 70 are shown in detail. Each seal ring 72, 73 is preferably a double lip or double wiper seal, and includes a base 74 and opposed wipers 76, 78 projecting upwardly and outwardly from opposite sides of the base 74 to form a recess 82 therebetween. The base 74 and wipers 76, 78 are preferably manufactured in one piece from ultra high molecular weight polyethylene. A spreader spring 80, preferably configured from stainless steel, is located in the recess 82 between the wipers 76, 78. The spreader spring 80 biases the inner wiper 76 into contact with the base of the groove 68, 70, and also biases the outer wiper 78 into contact with the inner surface of the shell 22. The positioning of the seal rings 72, 73 in the piston 34 provides a buffer annulus 84 in the area bonded by the seal rings 72, 73 within the upper and lower grooves 68, 70, the wall of the shell 22 and the outer cylindrical surface 62 of the piston 34. This buffer annulus 84 provides an intervening chamber between the conditions within the variable volume 32 and the conditions on the lower face 64 of the piston 34 to isolate the variable volume 32 from contamination. Preferably, the inner wall of the shell 22 is honed to a finish of 8 microinches, and then further electropolished to yield a 2 to 8 microinch electropolished surface. The alignment of the seal rings 72, 73 within the grooves 68, 70, in combination with the 2 to 8 microinch electropolish finish on the inner wall of the sleeve, helps to ensure that no materials will leak from the variable volume 32 and past the piston 34 and minimal particles of seal materials will be generated as the seals 72, 73 move over the inner wall of the shell. Generally, if any leaks occur past these seal rings 72, 73, the batch of centrate 18 being processed in the apparatus 10 must be destroyed. In the preferred configuration, the seal rings 72, 73 are received in the grooves 68, 70 such that the recess 82 in the seal ring 72 in the upper groove 68 is exposed to the variable volume 32, and the recess 82 in the seal ring 72 in the upper groove 68 is exposed to the volume within the cylinder 30 below the piston 34. This configuration helps additionally load the outer wipers 78 of the seal rings 72 into engagement with the inner wall of the shell 22 as the piston 34 is moved under pressure. The multiple element configuration of the piston 34 allows the use of semi-rigid seals 72, 73, because the seals 72, 73 are assemble into the piston 34 as the individual disks 33 that form the body of the piston 34 are assembled. To facilitate this assembly, the outer disks 33*a* and 33*c* preferably include a square cut groove formed around the outer perimeter of one of the faces thereof, which when abutted against the adjacent center disk 33*b* forms the seal grooves 68, 70.

To move the piston 34 upwardly in the sleeve 22, clean filtered air under pressure is applied to the lower face 66 of the piston 34 which loads the piston 34 against the centrate 18 in the variable volume 32. This increases the pressure within the cylinder 20 on both sides of the piston 34, which increases the pressure in the recess 82 of both of the seals 72, 73 and therefore increases the load pressure between the wipers 78 of both of the seals 72, 73 and the inner wall of the shell 22 as the piston 34 moves upwardly in the sleeve 22. As the materials in the variable volume 32 in the cylinder 20 are forced upwardly, they travel through the fluid interchange 60 and into the second cylinder 40. There, they load onto the piston 34' in the second cylinder 40 causing the piston 34' to move downwardly in the sleeve 22'. The pressure which builds within the second cylinder 40 as the centrate 18 is forced therein pressurizes the recess 82' in the upper seal member 72' to bias the wiper 78' outwardly against the shell 22' to help prevent leakage of the centrate 18 past the piston 34'. Likewise, when clean filtered air under pressure is applied to push the piston 34' upwardly in the shell 22', the air pressure acting on the seal member 73' will additionally bias the wiper thereof into engagement with the inner wall of the shell 22', and the centrate loading on the upper surface of the piston 34' in the shell 22', and on the piston 34 in shell 22, will additionally bias the wipers 78, 78' of the seals 72, 72' against the inner wall of their respective shells 22, 22'.

E. THE ASSEMBLY OF THE APPARATUS FOR THE LOADING AND MIXING OF CENTRATE

Once the cylinder components, crossover components and miscellaneous fittings have been sterilized, the cylinders 20, 40 must be assembled, and the crossover 60 configured, to begin the loading, monitoring and redistributing of the centrate 18. Preferably, the assembly of the apparatus 10 is performed in a class 100 clean room. Further, to ensure accurate measurement of the centrate 18 and the carrier liquid, the apparatus 10 should be configured for easy measurement of the centrate 18 and the carrier liquid. Therefore, in the preferred embodiment the carts 200, 202 with the sleeves 22, 22' thereon are pushed up a ramp 209 and onto a scale 211 maintained in the clean room. Once the carts 200, 202 are located on the scale 211, the cylinders 20, 40 may be assembled. The assembly of the covers 28, 30 and the various valves and fittings is relatively straightforward so long as sterility is maintained. However, the loading of the piston 34 requires great care.

1. Loading the Piston

The loading of the piston 34 into the cylinder 20 must be undertaken with great care, so as not to affect the integrity of the seals 72, 73. Referring again to FIG. 3, the very small gap 35 between the piston 34 and the inner wall of the sleeve 22, on the order of 0.004 inches where the sleeve 22 has an inner diameter of approximately 8.25 inches, provides very little tolerance for aligning the piston 34 and the seals 72, 73, into the sleeve 22. Where such a small gap 35 is present, the outer wiper 78 of the seal 72 will tend to bind, twist or tear against the intersection of the inner wall of the shell 22 and the shell end 24 or 26, and the piston 34 can easily cock or bind as the piston 34 is lowered or pressed into the shell 22. In particular, as the piston 34 is pressed into the lower end 24 of the shell 22, the piston 34 can contact the shell 22, and dent, scratch or otherwise damage either component, and the wiper 78 of the seal 72 can engage the end 24 of the shell 22 and further pressing of the piston 34 into the shell 22 may bend all or a portion of the wiper 78 back upon itself. In the best case, this will merely reduce the effectiveness of the seal 72. At worst, it will destroy the seal 72. The outer wiper 78 of the seal 72 could be bent with a shim or feeler gage as the piston 34 is loaded into the shell 22, but these tools could nick or cut the seal 72 or damage the piston 34 and/or the sleeve 22 and thereby damage the sealing characteristics of the seal 72. Therefore, to load the piston 34 into the shell 22, the seals 72, 73 must be easily retracted into their respective grooves 68, 70, but then allowed to actuate their outer wipers 78 into contact with the inner wall of the shell 22 once the piston 34 is received in the sleeve 22, and the piston 34 must enter the sleeve 22 with minimal misalignment.

Figure 7:
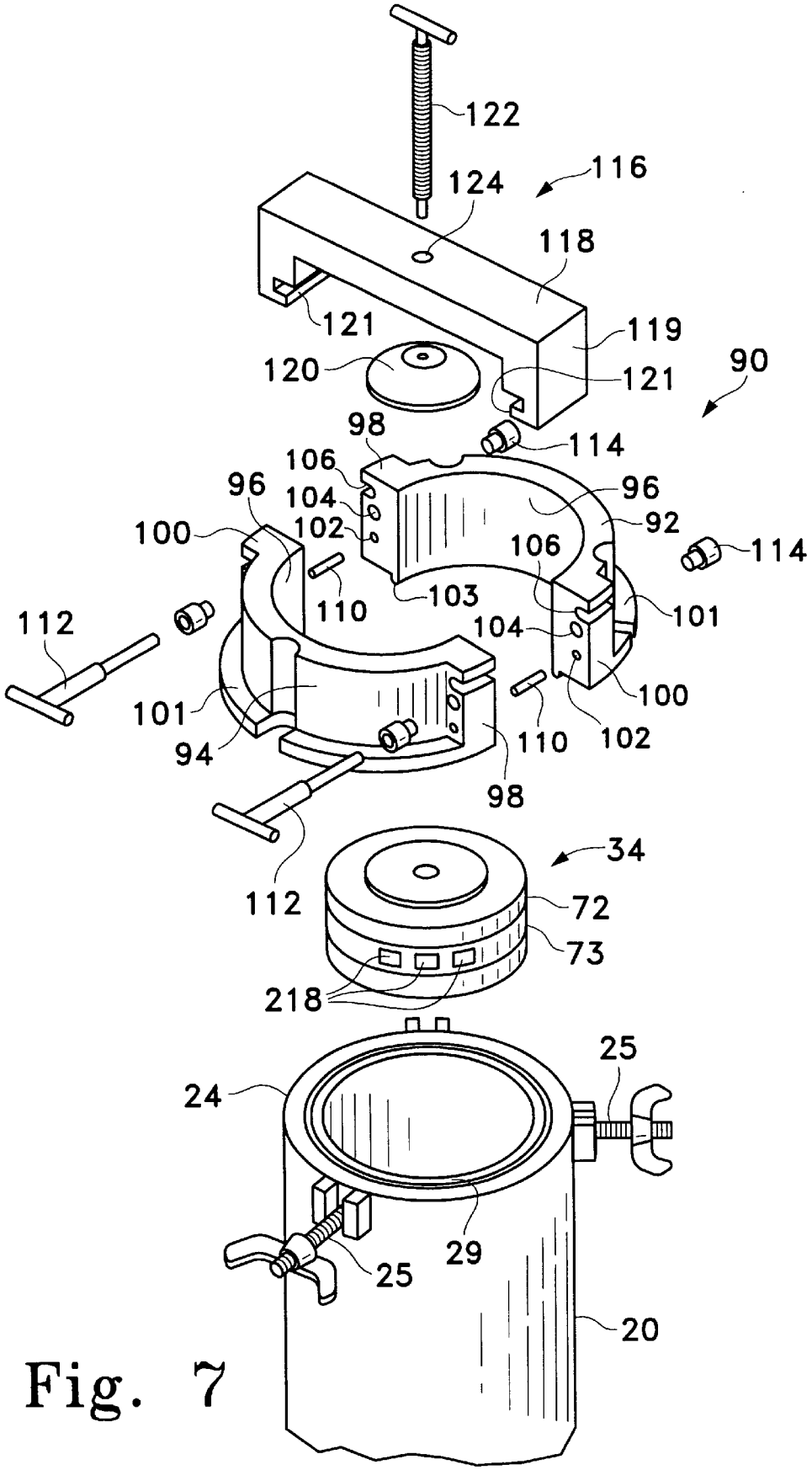
FIG. 7 is an exploded view of the piston loading assembly of the present invention.

Referring now to FIG. 7, an exploded view of a load assembly 90 is shown for loading the piston 34 into the cylinder 20 without binding the seals 72, 73 as they are enter the shell 22. To load the piston 34 into the shell 22, the shell 22 is inverted on the carrier 200 such that the lower open end 24 of the shell 22 is upright. The piston 34 is then received in a pre-sterilized load assembly 90. The load assembly 90 is then attached to the upright lower end 24 of the shell 22 and the piston 34 is pressed therefrom into the shell 22. The load assembly 90 depresses the seals 72, 73 into the seal grooves 68, 70 and maintains the seals 72, 73 in a depressed position as the seals 72, 73 enter the sleeve 22. It therefore prevents the rolling, binding, twisting or tearing of the seals 72, 73 as the piston 34 enters the sleeve 22. Further, the load assembly 90 maintains the outer circumferential wall 62 of the piston 34 aligned with the inner wall of the shell 22. This helps prevent the piston 34 from contacting the inner wall of the shell 22 as the piston 34 enters the shell 22.

In the preferred embodiment, the load assembly 90 includes a pair of semicircular clamp halves 92, 94 which are interconnected about the piston 34. Each of the clamp halves 92, 94 includes a semi-cylindrical inner portion 96, opposed connection flanges 98, 100 disposed approximately 180 apart on the opposed ends of the semi-cylindrical inner portion 96, and a rearwardly projecting lower flange 101 having an alignment tongue 103 (shown only on clamp halve 92) projecting downwardly therefrom and extending along the underside of the lower flange 101 in a semicircular arc. Further, each of the connection flanges 98, 100 includes an alignment dowel hole 102, a clamping aperture 104 and a loading slot 106 therein (shown clearly in halve 92). When the clamp halves 92, 94 are connected together around the piston 34, the dowel hole 102, clamping aperture 104 and loading slot 106 on each flange 98, 100 on one of the clamp halves 92 align with the dowel hole 102, clamping aperture 104 and loading slot 106 on the mating flange 98, 100 on the other of the semicircular clamp halves 94.

To form the load assembly 90, the clamp halves 92, 94 are placed around a piston 34, and a dowel 110 is placed in the dowel holes 102 of one of the clamp halves 92, 94. The clamp halves 92, 94 are then brought into proximity to connect the dowel 110 into the dowel holes 102 in each of the flanges 98, 100, such as by impacting the clamp halves 92, 94 with a plastic mallet. Then, to interconnect the clamp halves 92, 94 over a piston 34, the clamp halves 92, 94 are interconnected by tee handled studs 112 inserted through each of the clamping apertures 104 and threaded into a nut 114 held on the back side of the aperture 104 in the opposite flange 96 or 98. The flange 98 of the clamp halve 92 may be brought into contact with the flange 100 of the opposite clamp halve 94, and the flange 98 of the clamp halve 94 may be brought into contact with the flange 100 of the opposite clamp halve 92 by turning the tee handled studs 112 to bring the halves 92, 94 together. The semi-cylindrical portions 96 of the clamp halves 92, 94, when loaded about the piston 34, depress the wipers 78 of the seals 72, 73 into the seal grooves 68, 70 of the piston 34 to a position such that the furthest outward extension of the wipers 78 is less than the gap 35 between the outer circumferential wall 62 of the piston and the inner wall of the sleeve 22 when the piston 34 is fully received in the sleeve 22. The piston 34, with the seal wipers 78 in the depressed position, is then located over the upright lower open end 24 of the cylinder 20 such that lower flange 101 of the load assembly may be attached to the lower open end 24 of the sleeve 22, preferably with the swinging nut and wing bolt combinations 25. to align the clamp halves 92, 94 and the piston 34 therein with the sleeve 22, the alignment tongue 103 of each clamp halve 92, 94 is configured to form a semicircular extending rib that is received into the seal groove 29 in the end 24 of the sleeve 22 as the clamp halves are placed on the sleeve end 24. Once the load assembly 90 is affixed to the cylinder 20, the piston 34 is pressed out of the clamp halves 92, 94 and into the cylinder 20 or 40. When the clamp halves 92, 94 are connected over the piston 34, the inner diameter between the semi-cylindrical inner portions 96 is equal to, or slightly smaller than, the inner diameter of the sleeve 22. Therefore, as the piston 34 is pressed from the load assembly 90, the outer wipers 78 of the seals 72, 73 will be positioned radially inwardly of the inner wall of the sleeve 22 as the seal 72 or 73 exits the load assembly 90 and enters the sleeve 22.

The loading of the seal wipers 78 against the clamp halves 92, 94 will essentially lock the piston 34 in place in the load assembly 90 unless a large force is applied to the piston 34 to force it from the load assembly 90. To provide the force to press the piston 34 into the cylinder 20, the load assembly 90 preferably includes a integral press portion 116. Preferably, this integral press portion 116 includes a cross bar 118 extending between the clamp halves 92, 94 and over the center of the piston 34, a bearing plate 120 disposable against the piston 34, and a lead screw 122 extending through a threaded aperture 124 in the cross bar 118 and terminating on the bearing plate 120. The cross bar 118 includes a downwardly projecting lip 119 at either end thereof, which includes an inwardly projecting tongue 121 thereon. The tongue 121 may be slid into the loading slots 106 in each pair of opposed flanges 98, 100. Thus, the cross bar 118 may be slid onto and off of the clamp halves 92, 94, but held rigidly in a longitudinal direction by the tongues 121 in the slots 106. Once the cross bar 118 is positioned in the slots 106, the lead screw 122 is turned to actuate the bearing plate 120 downwardly against the piston 34 to force the piston 34 into the sleeve 22. Preferably, the lead screw 122 engages the bearing plate 120 against the center of the piston 34. By loading the center of the piston 34, the piston 34 will enter the sleeve 22 with minimal cocking or binding.

2. Access Openings for Connecting the Cylinders

Figure 8:
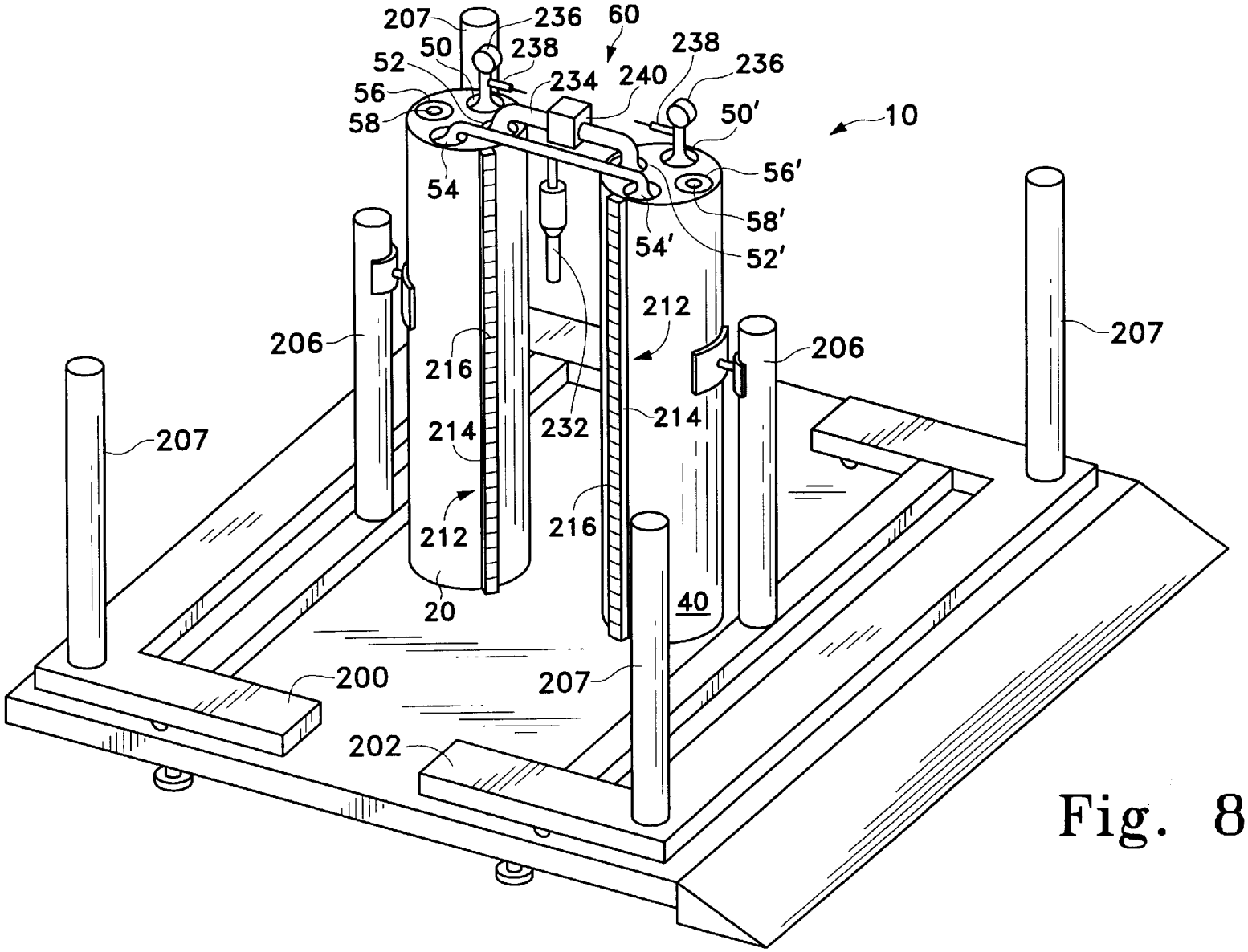
FIG. 8 is a perspective view of the apparatus of the present invention, partially in section, configured for pressure testing.

Referring now to FIG. 8, the interconnection of the cylinders 20, 40 to pass the centrate 18 between the two cylinders 20, 40 is provided by the fluid interchange 60. To provide access of the variable volumes 32, 32' within the cylinders 20, 40 to the fluid interchange 60, the upper cover plate 28, 28' of each of the cylinders 20, 40 includes a plurality of openings therethrough, to which multiple conduits may be attached to communicate between the variable volume 32 in the first cylinder 20 and the variable volume 32' in the second cylinder 40. The openings include a first set of openings 50, 50', a second set of openings 52, 52' and a third set of openings 54, 54'. Each of the sets of openings may, if desired, be interlinked by a conduit to form all or a portion of the fluid interchange 60. Additionally, the openings may be used as ports to place fluids, such as carrier fluids, particulates or solids such as the collagen centrate 18, or vacuum or air supplies into the variable volumes 32, 32'. The upper cover plates 28, 28' also include an aperture 56 which is configured to receive a sensor 58 therein, preferably a proximity probe, which detects the presence of the piston 34 adjacent the top of the cylinder 20.

3. The Piston Level Indicator

During the redistribution and de-aggregation of the centrate 18, it must be sampled to determine the concentration of collagen in different locations in the volume of the centrate 18. Because the cylinders 20, 40 are solid sealed members, an operator cannot visualize the location of the pistons 34, 34' in the cylinders 20, 40 and thus cannot easily determine whether concentration samples are being taken from substantially different locations in the volume of centrate 18. Therefore, each shell 22 includes a level indicator 212 disposed longitudinally on the outer surface thereof. The indicator 212 is preferably configured to provide an easily viewed indication of the level of the piston 34 within the cylinders 20, 40. One such indicator is a flag type indicator, wherein a plurality of paddles 216 are disposed within a channel member 214. The paddles 216 are supported on the side walls of the channel in low friction rotary connections, preferably by the receipt of the ends of a rod passing through the paddle 216 into the side walls of the channel 214. The channel 214 is affixed to the outer wall of the cylinders 20, 40. A plurality of magnets 218 is maintained are disposed within the piston 34, and the piston 34 and the channel 214 are assembled such that at least one of the magnets 218 (shown in FIG. 7) is maintained immediately behind the channel 214 within the cylinder 20 or 40. Thus, when the piston 34 moves in the cylinder 20 or 40, it sweeps a magnet along the back of the channel 214. Each of the paddles 216 have a brightly colored side and a dark side. When the magnet 218 sweeps past each paddle 216, it flips the paddle 216 over about the rod to change the color of the paddle 216 as viewed through the indicator 212. Because a plurality of paddles 216 are disposed within the channel 214, the location on the channel 214 where the paddles 216 change from the dark color to the light color provides a visual display of the location of the piston 34. One indicator 212 having these properties is available from the MagTech Division of ISE of Texas, Inc. of Webster, Tex., under the designation "LG Series flipper/roller option." One skilled in the art will recognize that a number of different embodiments which include magnetically coupled indicators may be used to provide the piston level indicator. Further, a plurality of sensors may be provided on the exterior of the cylinders 20, 40 to sense the passage of the magnets 218 therepast, and these sensors may be coupled to a processor or controller to record, or in conjunction with the air supplies control, the location of the piston 34 in the cylinders 20, 40.

F. THE APPARATUS CONFIGURED FOR PRESSURE TESTING

Referring still to FIG. 8, the cylinders 20, 40 are shown configured for pressure testing. In this configuration, a vacuum/air feed line 232 is connected to the apertures 54, 54', a crossover line 234 interconnects the apertures 52, 52', and a pressure gauge 236 and quick connect fitting 238 are located in each of the apertures 50, 50'. A valve 240 is disposed in-line in the crossover line 234 to selectively isolate the two cylinders 20, 40 from each other. By selectively isolating the cylinders 20, 40 by closing the valve 240, and pressurizing or evacuating the cylinders through the feed line 232, any leakage of the cylinders 20, 40, or of the piston seals 72, may be located, and the free movement of the pistons 34, 34' within the cylinders 20, 40 may be checked.

G. CENTRATE LOADING

Figure 9:
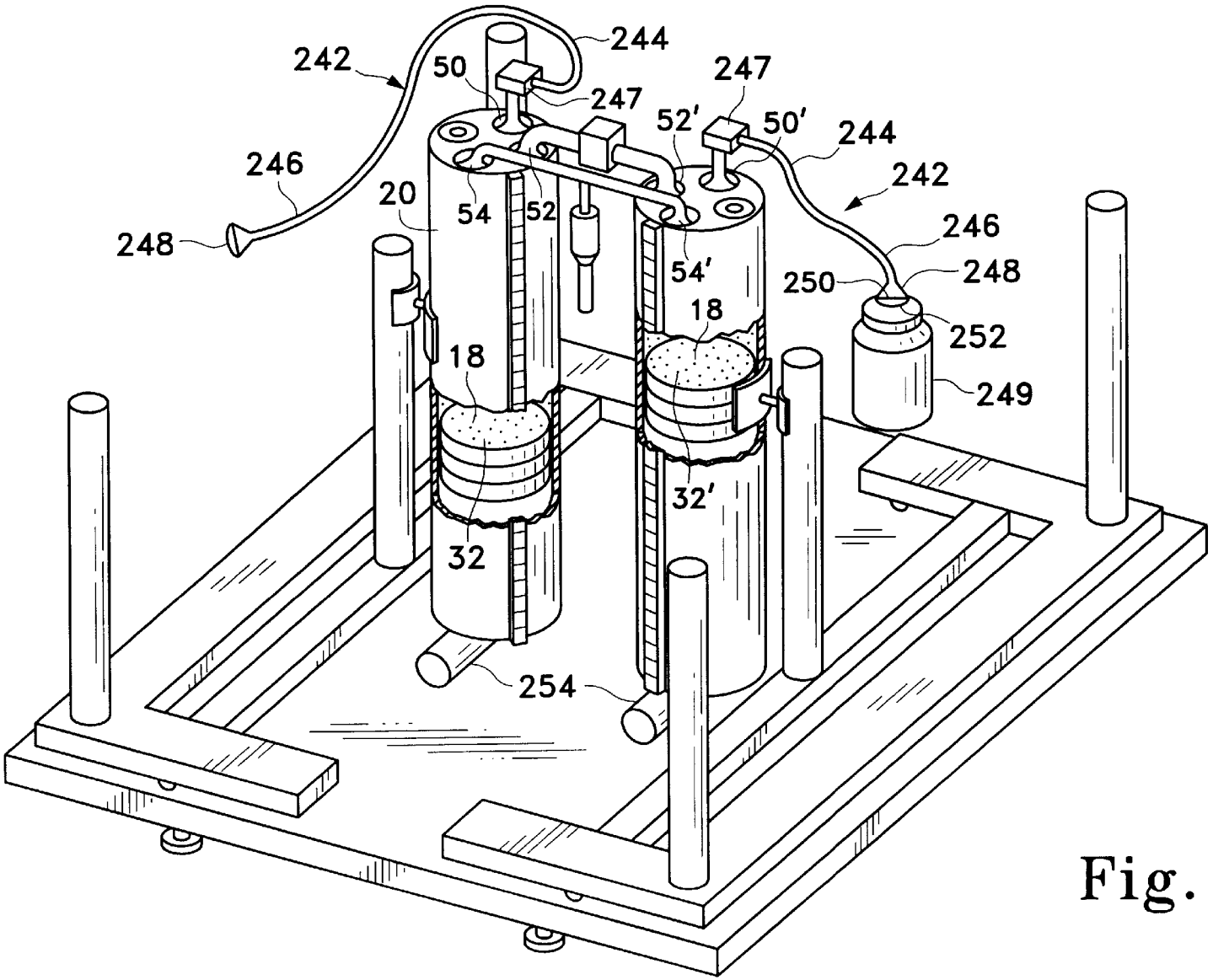
FIG. 9 is a perspective view of the apparatus of FIG. 8, partially in section, configured for centrate loading and sampling.

Referring now to FIG. 9, the configuration of the apparatus for receiving and weighing the centrate 18 is shown. To input centrate 18 into the cylinders 20, 40 without contaminating the centrate 18, a sterilized suction wand 242 is connected into each of the apertures 50, 50', preferably through a sterile hose 244 placed in series with an automatic valve 247. Each suction wand 242 includes a stem portion 246, which is preferably on the order of nine to twelve inches long, and a flared tip 248. The stem portion 246 must be sufficiently long to enable an operator to hold the wand 242 in his or her hand and manipulate the flared tip 248 in a centrifuge bottle 249. The flared tip 248 includes a flat portion 250 for scraping the base of the centrifuge bottle 249, and a rounded portion 252 to scrape the rounded wall of the centrifuge bottle 249.

To load the centrate 18 into the cylinders 20, 40 through the suction wands 242, the cylinders 20, 40 must be operated at a vacuum. To provide this vacuum, an air/vacuum supply hose 254 is fitted to the bottom plate 30 of each of the cylinders 20, 40 (as shown in FIG. 3), and a vacuum is drawn into the cylinder below the pistons 34. Simultaneously, an identical vacuum is drawn through the vacuum/air feed line 232. This creates a vacuum in the variable volume 32, 32' of the cylinders 20, 40 above the pistons 34, 34'. The vacuum in the upper portion of the cylinders 20, 40 draws the centrate 18 through the wands 242. Thus, to load the paste-like centrate 18 into the cylinders two operators, one using each of the wands 242, suck the centrate 18 out of the centrifuge bottles 249. By selectively opening the automatic valves 247 only when the wand 242 is in contact with centrate 18, minimal air will be drawn into the cylinders 20, 40. Preferably, the automatic valves 247 are operated by a foot switch, so that the operators may selectively open the valves 247 to suck centrate 18 into the wands 242.

H. DE-AERATION AND REDISTRIBUTE THE CENTRATE

Figure 10:
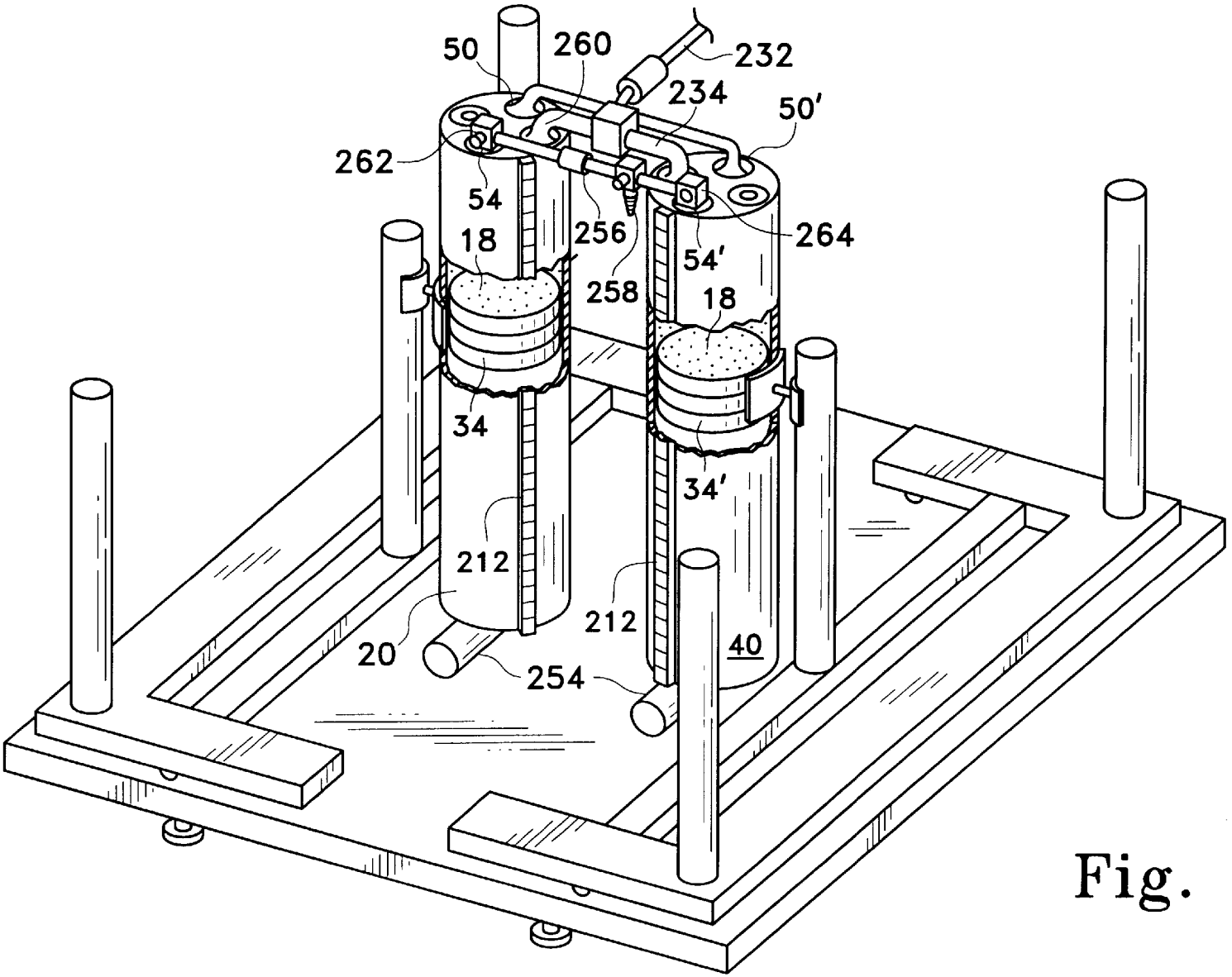
FIG. 10 is a perspective view of the apparatus of FIG. 8, partially in section, configured for centrate de-aeration.

Referring now to FIG. 10, the configuration of the cylinders 20, 40 for de-aerating the centrate 18 is shown. In the de-aeration mode, the cylinders 20, 40 are configured to remove entrained air from the centrate 18. The vacuum/air feed line 232 is disconnected from the apertures 54, 54' and connected across the apertures 50, 50'. A sightglass 256 is placed in series with a manual sampling valve 258, and this series assembly is connected between manual valves 262, 264 located in the apertures 54, 54' to form a small crossover line 260. The small crossover line 260 and the crossover line 234 together form the fluid interchange 60, and provide the total area through which the centrate 18 and the carrier will pass between the cylinders 20, 40 during mixing.

To de-aerate the centrate 18, a vacuum is pulled from the variable volumes 32, 32' of the cylinders 20, 40 containing the centrate 18, and from the underside of the pistons 34, 34'. Air entrained in the centrate 18 will froth out of the centrate 18, and be evacuated from the cylinders 20, 40 through the vacuum/air feed line 232. After the de-aeration step, but before mixing, the area below the pistons 34, 34' is vented, and the pistons 34, 34' move upwardly in the cylinders 20, 40 and into contact with the centrate 18. At this point the mixing of the centrate 18 to redistribute the fibril aggregates to create a homogenous concentration of collagen in the centrate 18, and to simultaneously reduce the maximum fibril aggregate size, may begin.

To perform the redistribution and de-aggregation of the fibrils and the fibril aggregates in the centrate, the lower circular faces 64, 64' of the pistons 34, 34' are alternatively pressurized, which alternately drives the pressurized pistons 34, 34' upwardly in the sleeves 22, 22' to force the centrate 18 back and forth through the crossover line 234 and small crossover line 260. Where the cylinders 20, 40 have an eight inch inner diameter, the crossover line 234 has a seven-eighths inch inner diameter and the small crossover line 260 has a three-eighths inch inner diameter, 17 liters of centrate 18 will be sufficiently redistributed and have an acceptable maximum fibril aggregate size after 30 to 150 upward and downward cycles of each of the pistons 34, 34'.

I. CENTRATE SAMPLING

The centrate 18 must be sampled to confirm that the operation of the apparatus 10 has properly redistributed the centrate 18 to create a uniform distribution of fibrils and fibril aggregates in the residual liquid medium, and to determine the proper amount of carrier liquid to add to the centrate 18 to form a final collagen product. To sample the centrate 18 one of the pistons, for example piston 34 in cylinder 20, is actuated fully upwardly to force the centrate 18 into cylinder 40. Then, the crossover line 234 is closed, the piston 34' is moved upwardly in short incremental steps, and samples of the centrate 18 are removed through the sampling valve 258 at each incremental step. To determine the position of the piston 34', and thus control the size of the incremental steps, the operator views the indicator 216 on the side of the cylinder 40 to determine the position of the piston 34' within the cylinder 40. The samples are then checked for collagen concentration, and for the uniformity of collagen concentration from sample to sample. If the samples have the desired concentration and uniformity, the centrate is then mixed with a carrier fluid. If the uniformity of the concentration is unacceptable, the centrate 18 is processed through another 50 cycles in the apparatus 10. If the concentration of the centrate 18 is too low, the centrate 18 is removed from the apparatus 10 and re-centrifuged. The sampled centrate 18 may also be evaluated for particle size, if desired, with a Olympus Cue-2 Image analyzer available from Olympus of Japan using the technique described herein supra for diluting the centrate 18 and determining the size of the silhouettes of the fibrils and fibril aggregates. This device will determine the mean fibril size and the range of fibril sizes from the mean to a specified number of standard deviations in a collagen centrate. If the maximum fibril aggregate size is too large, or if the quantity of the larger fibril sizes would require too many screen changes, the centrate may be returned to the cylinders 20, 40 for mixing. Once the desired redistribution of the collagen in the centrate 18 has been accomplished with the apparatus, the centrate 18 may be de-aggregated in the apparatus indefinitely without affecting the homogeneous concentration of the centrate 18.

J. ADDING THE CARRIER

Figure 11:
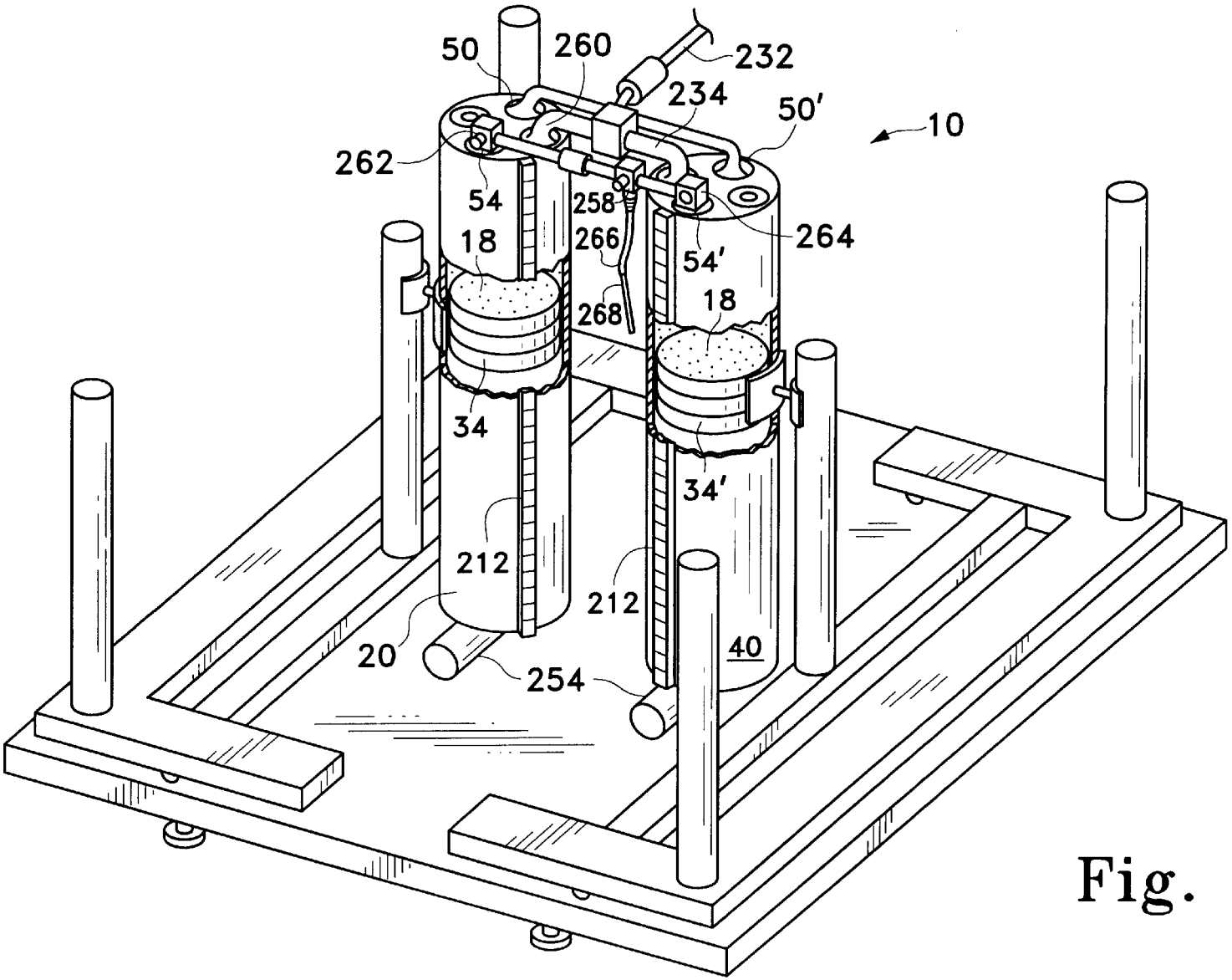
FIG. 11 is a perspective view of the apparatus of FIG. 8, partially in section, configured for carrier fluid loading.

Once the centrate 18 has been sufficiently redistributed and the maximum fibril aggregate size is lowered to an acceptable level the centrate 18 must be mixed into a carrier liquid, preferably a carrier liquid which renders the centrate isotonic. Once the centrate 18 is mixed with a carrier fluid, it becomes diluted centrate. Referring to FIG. 11, the apparatus 10 is configured for the addition of the carrier liquid, commonly one or more buffer materials, into the homogenized centrate 18. The carrier loading apparatus is preferably a short piece of silicone tubing 266 attached at one end thereof to the sampling valve 258, and a tubular wand 268 is attached to the free end of the tubing 266. To draw carrier into the cylinders 20, 40, the sampling valve 258 is opened and the tubular wand 268 is dipped into a sterile volume of carrier. Simultaneously, a vacuum is drawn through one or both of the air/vacuum supply hoses 232, 254 to draw the carrier into the cylinders 20, 40 through the tubular wand 268. Once the proper amount of carrier is drawn into cylinders 20, 40, the sampling valve 258 is closed and the vacuum below the pistons 34, 341 is allowed to backfill with air. The combination of homogenized centrate 18 and carrier is then mixed by alternatively pressurizing the lower circular faces 64, 64' of the pistons 34, 34' to force the centrate 18 and carrier fluid back and forth through the fluid interchange 60. After mixing, the diluted centrate 18 mixture must be sampled, and if necessary, remixed or further diluted with carrier. The sampling valve 258 again provides an easy source for sampling the mixture and for introducing more carrier to further dilute the diluted centrate, if necessary. Additionally, the sampling valve 216 is used in combination with the indicator 212 to sample the mixture at several locations within the fluid volume. By stepping the pistons 34 upwardly within their respective cylinders 20, 40 and noting the position of color change of the flippers 216 of the indicator 212, which color change corresponds to the position of the pistons 34 in the cylinders 20, 40, the operator may obtain samples from multiple locations within the volume of diluted centrate 18 and carrier.

K. CENTRATE SCREENING

Figure 12:
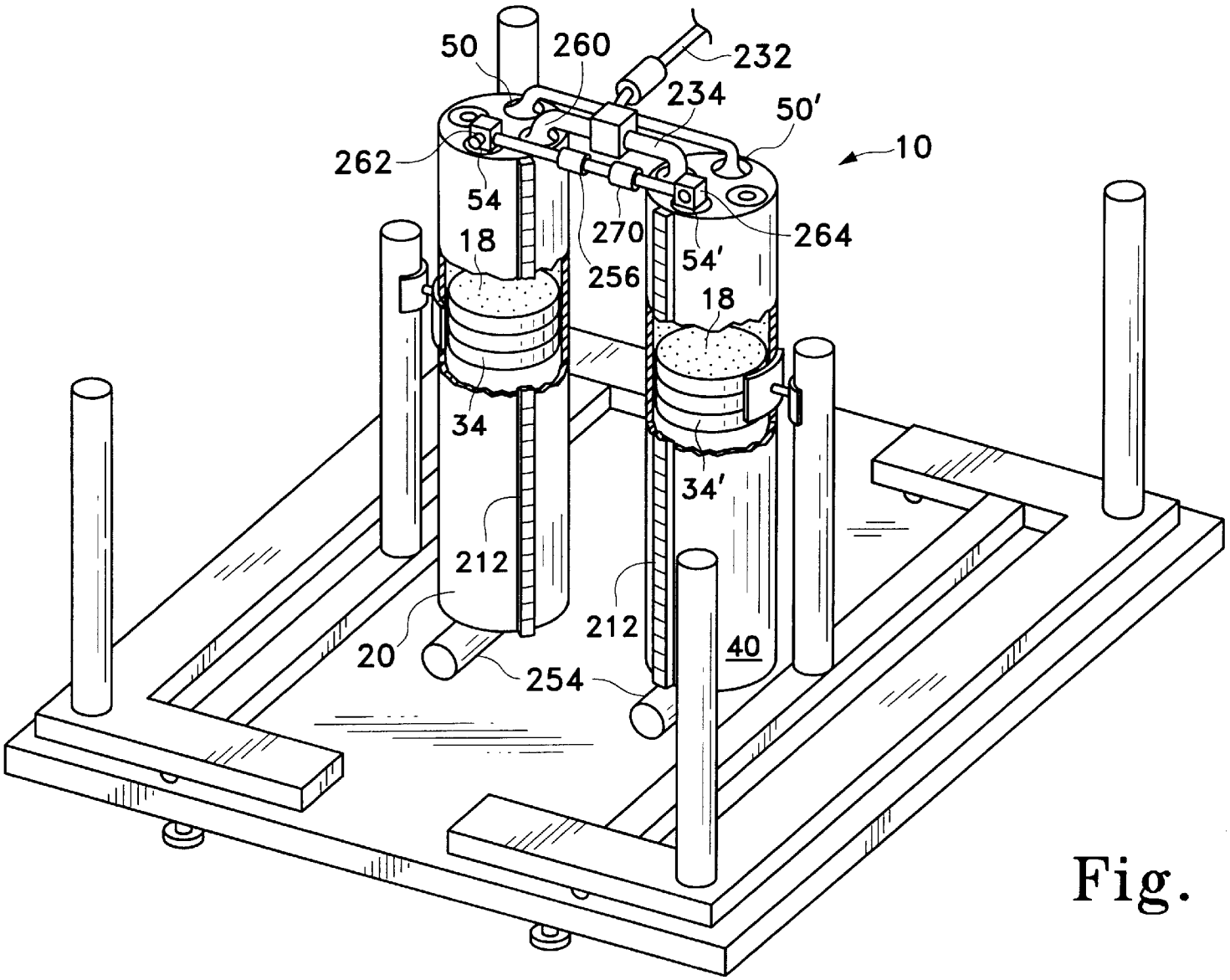
FIG. 12 is a perspective view of the apparatus of FIG. 8, partially in section, configured for centrate screening.

The mixing of the centrate 18 in the apparatus 10 is normally sufficient to cause nearly all of the fibril aggregates having sizes greater than the desired aggregate size to separate into smaller aggregates or individual fibrils. However, to ensure the complete removal of such oversized fibril aggregates, the diluted centrate is screened. To perform the screening function, the entire volume of the diluted centrate is forced into cylinder 20, and the manual valve 258 is removed and replaced with a screen housing 270 placed in line with the sightglass 256 as shown in FIG. 12. The screen housing 270 includes a screen therein, and the screen is selected so that the spaces in the screen mesh through which the diluted centrate is passed correspond to the size of the needle aperture through which the product that is ultimately produced from the batch of collagen must pass. The automatic valve 240 in the crossover line 234 is closed and the diluted centrate is then forced from cylinder 20 to cylinder 40 through the small crossover line 260. By monitoring the sightglass 256, the operator can determine if the screen in the screen housing 270 has become clogged. Whenever the screen becomes clogged, the transfer of the diluted centrate between the cylinders 20, 40 is stopped and the screen is replaced. Before replacing the screen, the valves 262, 264 are closed to prevent any unintended ejection of materials from the cylinders 20, 40. Thus, when the piston 34 reaches the top of the cylinder 20 the entire volume of the diluted centrate in the second cylinder 40 has a certifiable maximum fibril aggregate size.

L. THE SECONDARY DE-LUMPING APPARATUS

Figure 13:
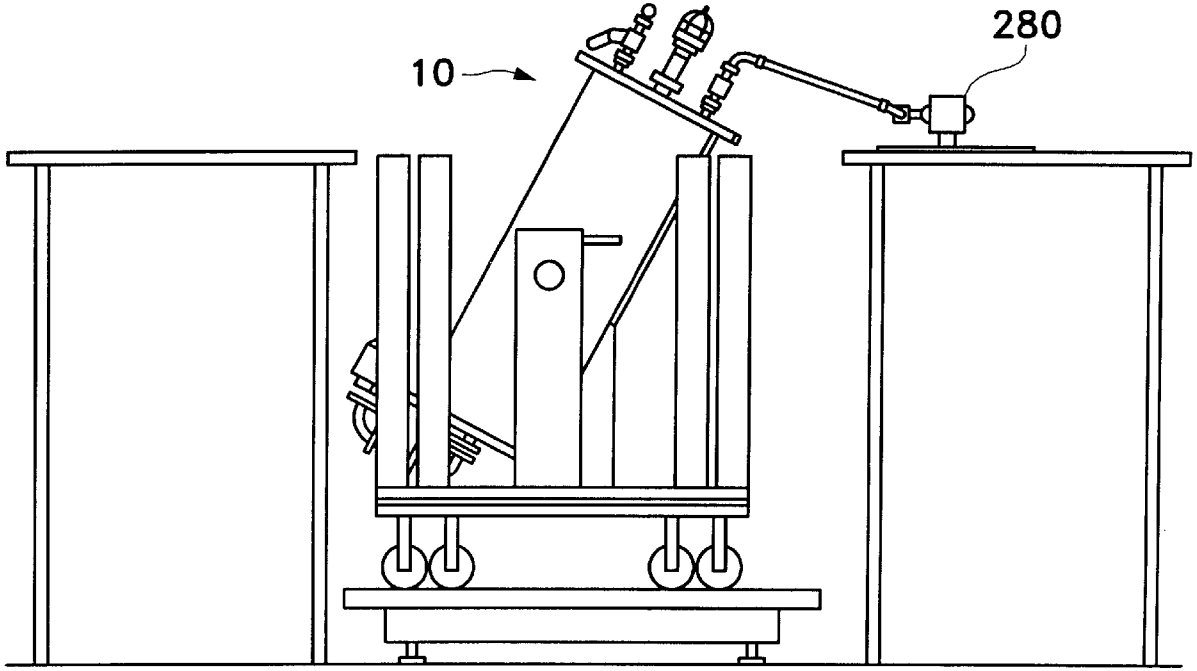
FIG. 13 is a perspective view of the apparatus of FIG. 8 configured for centrate de-lumping.

The foregoing screening process is not practical with certain collagen compositions, in particular the highly cross-linked compositions, because too many screen changes would be required. Therefore, a secondary fibril aggregate size reducer must be used to further reduce the fibril aggregate size of this composition. Referring now to FIG. 13, an apparatus configuration for further reducing the fibril aggregate size is shown. In this configuration, the diluted centrate is passed through a secondary de-lumping mixer 280 as it is pushed from cylinder 40 to cylinder 20. The secondary de-lumping mixer 280 is a piston pump, which converts the mixture exiting from the cylinder 40 into two high velocity streams, and impinges these streams together in a 300 micron chamber at 2500 to 3000 psi which causes cavitation of the stream to cause further separation of the fibril aggregates. This mixer 280 vigorously mechanically disrupts the centrate, and reduces the average fibril aggregate size by an amount sufficient to ensure that it will pass through a standard gauge needle, wherein the needle size varies with the intended use of the collagen. The de-lumped dilute centrate is then screened as would be any other diluted centrate. One apparatus useful as the mixer 280 is available from Microfluidics Corporation, Newton Mass., under the designation HC-5000 Laboratory Homogenizer.

M. THE CONTROL APPARATUS

Figure 14:
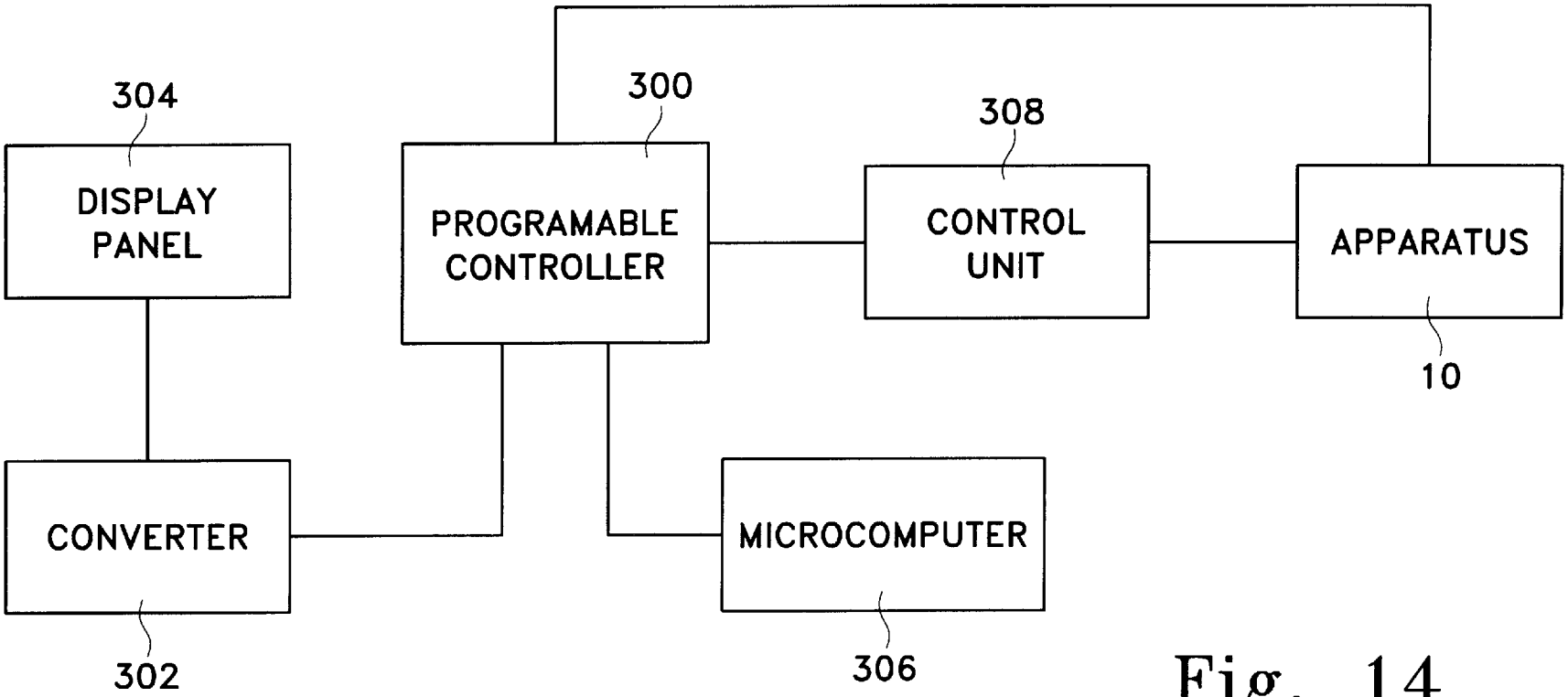
FIG. 14 is a schematic of the preferred embodiment of the control system for controlling the apparatus of the present invention.

Referring now to FIG. 14 the preferred control apparatus of the present invention includes a programmable controller 300 which is connected to a convertor 302 which is in turn connected to a touchview display panel 304. Additionally, a microcomputer 306, such as an IBM compatible 386 microcomputer, is connected to the process controller 300 to a state logic processor in the controller 300. The controller 300 is configured to control the function of a mixing control unit 308 having multiple electric and pneumatic control switches therein. The control unit 306 is connected to supplies of filtered shop air and vacuum. The control unit 308 receives inputs from the controller 300 to control the function of the control switches which are configured to control the flow of air and the vacuum to the pistons 34, 34'.

The touchview display 304 provides visible indications of the operation of the apparatus 10, and it may also receive operator inputs to the controller 300. Finally, the controller 300 reads inputs from the operator internal logic to control the mixing cycle.

III. CONCLUSION

Once the centrate 18 is redistributed, de-aggregated, mixed with a carrier and then screened and de-lumped if necessary, it is ready for further processing. The cylinders 20, 40 are specifically configured to be transportable, and the entire cylinder 20 or 40 having the collagen and carrier mixture therein may be simply wheeled into the next manufacturing area to be placed into syringes, implant materials or other configurations. This configuration allows the collagen to be transported to an additional processing station without compromising its sterility.

The embodiments of the invention described herein allow a combination of fluids and particulate matter, including collagen centrate 18 or diluted collagen centrate, to be intermixed to provide a homogenous concentration of collagen fibrils and fibril aggregates in the centrate 18 or carrier liquid, and, if necessary, reduce the maximum fibril aggregate size. Although the invention is particularly suited for high viscosity fluid mixing, such as the redistributing of collagen in a centrate 18, and mixing that redistributed centrate 18 into a carrier liquid, the invention may be used to mix many combinations of particulates and liquids, liquids and liquids, or even flowable particulates and particulates, and perform that mixing in a sterile environment. The invention is of particular use where a high viscosity, high value product must be mixed and maintained in a sterile environment, because the quantity of hold up is minimal.

We claim:

1. A method of distributing a combined volume of materials formed of a first material and a second material, comprising:

a) providing an apparatus including;

a first variable volume member and a second variable volume member, each variable volume member including a free floating piston movably received therein;

a fluid interchange defining a flow passage interconnecting the first variable volume member and the second variable volume member;

wherein each variable volume member includes a rigid wall, and wherein at least one double lip seal or double wiper seal is disposed intermediate the rigid wall and the piston in each variable volume member, and the seal is capable of being energized into sealing engagement against the rigid wall, in part by pressure increases within the variable volume member;

b) placing the combined volume of materials in the apparatus in at least one of the first variable volume member, the second variable volume member and the fluid interchange; and c) alternately reducing the volume of the first variable volume member and the second variable volume member a pre-selected number of times to pass the combined volume of materials through the flow passage that pre-selected number of times.

2. The method of claim 1, wherein step b) comprises placing in the apparatus the combined volume of materials formed of a first material and a second material, wherein the first material is a particulate which includes fibril collagen aggregates and the second material is a liquid residual carrier medium, and wherein step c) comprises passing the materials through the flow passage to form a homogenous liquid suspension.

3. The method of claim 2, wherein step c) comprises moving the pistons within the variable volume members.

4. The method of claim 3, wherein step a) further comprises providing an apparatus including at least two double lip seals or double wiper seals disposed intermediate the rigid wall and the piston in each variable volume member.

5. The method of claim 3 wherein each free floating piston is pneumatically or hydraulically driven, and wherein step c) comprises pneumatically or hydraulically moving the pistons within the variable volumes.

6. The method of claim 2, wherein step c) further comprises forcing the combined volume of materials is back and forth between the variable volumes at least 30 times.

7. The method of claim 1, wherein the cross sectional area of the variable volume members is at least 20 times the cross sectional area of the flow passage, and wherein step c) comprises passing the materials through the flow passage to form a homogenous liquid suspension.

8. The method of claim 2, further comprising sterilizing the combined volume of materials prior to step b), and wherein the materials remain sterile during step c).

9. The method of claim 1, wherein step a) further comprises providing in the seal a loading spring, and wherein step c) comprises passing the materials through the flow passage to form a homogenous liquid suspension.

10. The method of claim 1, wherein step b) comprises placing in the apparatus the combined volume of materials formed of a first material and a second material, wherein the first material is a particulate and the second material is a liquid, and wherein step c) comprises passing the materials through the flow passage to form a homogenous liquid suspension.

11. The method of claim 1, wherein step b) comprises placing in the apparatus the combined volume of materials formed of a first material and a second material, wherein the first material comprises collagen fibrils and the second material is a liquid, and wherein step c) comprises passing the materials through the flow passage to form a homogenous liquid suspension.

12. An apparatus for distributing a first material into a second material, the apparatus comprising:

a first member having a variable volume and a second member having a variable volume, each member including a rigid wall; and a fluid interchange defining a flow passage interconnecting said first variable volume member and said second variable volume member;

wherein each member includes a free floating piston movably received therein having at least a first position at which said variable volume has a maximum volume and a second position wherein said variable volume has a minimum volume; and wherein each piston includes an outer circumferential wall, and at least one double lip seal or double wiper seal is disposed in engagement with the outer circumferential wall and the rigid wall of the member.

13. The apparatus of claim 12, wherein the total volume of said first variable volume, said second variable volume and said fluid passage is equal to the combined volume of the first material and the second material.

14. The apparatus of claim 12, wherein the cross sectional area of the variable volume members is at least 20 times the cross sectional area of the flow passage.

15. The apparatus of claim 12, wherein each said piston includes an outer circumferential wall, and at least two double lip seals or double wiper seals are disposed in engagement with said outer circumferential wall and said rigid wall.

16. The apparatus of claim 15, wherein at least one of said seals is a double lip seal.

17. The apparatus of claim 15, wherein said seals form bearing surfaces to guide said piston in said member.

18. The apparatus of claim 15, wherein said seals are capable of being partially energized into sealing engagement with said rigid wall by increasing the pressure within the combined volume.

19. The apparatus of claim 12 wherein each seal is a double lip seal.

20. The apparatus of claim 12, wherein said seals are capable of being partially energized into sealing engagement with said rigid wall by increasing the pressure within the combined volume.

21. The apparatus of claim 12 wherein each free floating piston is capable of being pneumatically or hydraulically driven within the variable volume member.

22. The apparatus of claim 12 further comprising means for pneumatically or hydraulically moving each free floating piston within the variable volume member.

23. The apparatus of claim 22 wherein said means for moving the free floating piston comprises a pneumatic moving means.

24. The apparatus of claim 23 further comprising a control system for controlling the pneumatic movement of the pistons.

25. The apparatus of claim 24 wherein said control system comprises a programmable controller for controlling the pneumatic movement of the pistons.

26. The apparatus of claim 12 further comprising collagen fibrils disposed in at least one of the first member, the second member and said flow passage.

* * * * *